US011660650B2

(12) United States Patent
Okada et al.

(10) Patent No.: US 11,660,650 B2
(45) Date of Patent: May 30, 2023

(54) APPARATUS FOR AND METHOD OF MANUFACTURING ROLL-FORMED COMPONENT

(71) Applicant: KAWASAKI JUKOGYO KABUSHIKI KAISHA, Kobe (JP)

(72) Inventors: Hideki Okada, Kakamigahara (JP); Yoichiro Honda, Mizuho (JP); Yasuhiro Kasumi, Seki (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 252 days.

(21) Appl. No.: 17/319,573

(22) Filed: May 13, 2021

(65) Prior Publication Data

US 2021/0276063 A1 Sep. 9, 2021

Related U.S. Application Data

(63) Continuation of application No. 16/215,761, filed on Dec. 11, 2018, now Pat. No. 11,040,386.

(30) Foreign Application Priority Data

Dec. 11, 2017 (JP) ..... JP2017-236670

(51) Int. Cl.
*B21D 5/08* (2006.01)
*B21D 5/00* (2006.01)
(Continued)

(52) U.S. Cl.
CPC ..... *B21D 5/08* (2013.01); *B21D 5/004* (2013.01); *B21D 5/12* (2013.01); *B21D 5/14* (2013.01); *B21D 7/08* (2013.01); *B21D 7/12* (2013.01)

(58) Field of Classification Search
CPC ..... B21D 5/08; B21D 5/12; B21D 5/14
See application file for complete search history.

(56) References Cited

U.S. PATENT DOCUMENTS 3,906,765 A * 9/1975 Foster ..... B21D 5/004 72/8.9
3,955,389 A 5/1976 Foster
(Continued)

FOREIGN PATENT DOCUMENTS

JP 2001-047260 A 2/2001

OTHER PUBLICATIONS

Oct. 19, 2020 Office Action issued in U.S. Appl. No. 16/215,761.
Mar. 26, 2021 Notice of Allowance issued in U.S. Appl. No. 16/215,761.

*Primary Examiner* — Shelley M Self
*Assistant Examiner* — Jared O Brown
(74) *Attorney, Agent, or Firm* — Oliff PLC

(57) ABSTRACT

To a fulcrum roll unit portion in a workpiece, a corresponding initial curvature radius is applied, and to a bending roll unit portion in a workpiece, a corresponding design curvature radius is applied. To an intermediate unit portion in a workpiece, an intermediate curvature radius set so as to continuously change from the initial curvature radius to the design curvature radius is applied. At least one of the fulcrum roll and the bending roll is moved on the basis of an integrated value obtained by integrating the amount of change in bending position in each of the intermediate unit portion and the bending roll unit portion.

18 Claims, 12 Drawing Sheets

(51) Int. Cl.

| | |
|---|---|
| ***B21D 7/08*** | (2006.01) |
| ***B21D 7/12*** | (2006.01) |
| ***B21D 5/14*** | (2006.01) |
| ***B21D 5/12*** | (2006.01) |

(56) References Cited

U.S. PATENT DOCUMENTS

| | | | | |
|---|---|---|---|---|
| 4,047,411 | A * | 9/1977 | Foster | B21D 5/14 72/7.2 |
| 4,080,815 | A * | 3/1978 | Foster | B21D 7/08 72/65 |
| 4,910,984 | A * | 3/1990 | Young | B21D 7/08 72/166 |
| 2009/0107199 | A1 | 4/2009 | Li et al. | |
| 2011/0094278 | A1 * | 4/2011 | Caporusso | B21D 7/08 72/17.3 |
| 2017/0157660 | A1 * | 6/2017 | Sasaki | B21D 43/09 |
| 2017/0333968 | A1 * | 11/2017 | Turanjanin | B21D 7/14 |

* cited by examiner

| | Position | R0 | n0 | n1 | n2 | n3 | n4 |
|---|---|---|---|---|---|---|---|
| D5 | 1000 | 2000 | 1960 | 1970 | 1980 | 1990 | 2000 |
| D4 | 1010 | 2000 | 1960 | 1970 | 1980 | 1990 | 2000 |
| D3 | 1020 | 1950 | 1910 | 1920 | 1930 | 1940 | 1950 |
| D2 | 1030 | 1900 | 1860 | 1870 | 1880 | 1890 | 1900 |
| D1 | 1040 | 1850 | 1810 | 1820 | 1830 | 1840 | 1850 |
| | 1050 | 1800 | 1760 | 1770 | 1780 | 1790 | 1800 |

APPARATUS FOR AND METHOD OF MANUFACTURING ROLL-FORMED COMPONENT

CROSS REFERENCE TO RELATED APPLICATION

This is a Continuation of application Ser. No. 16/215,761 filed Dec. 11, 2018, which claims the benefit of priority to Japanese Patent Application No. 2017-236670 filed on Dec. 11, 2017 to the Japan Patent Office. The disclosures of the prior applications are hereby incorporated by reference herein in their entirety.

BACKGROUND OF THE INVENTION

(1) Field of the Invention

The present invention relates to an apparatus for and a method of manufacturing a roll-formed component, capable of continuously adjusting or controlling curvature of the roll-formed component along its longitudinal direction.

(2) Description of Related Art

Frame components used for manufacturing of an aircraft include a stringer, a stiffener, a spar, a floor beam, a rib, a frame, a doubler, and the like, for example. Examples of a method of manufacturing the frame components include roll forming. In the roll forming, a flat metal material is formed in a shape with a predetermined cross-sectional shape by a plurality of roll members. A contour (bent shape) is provided to a frame component formed in a shape with a cross section as described above, in many cases. Performing roll bending after roll forming enables a frame component provided with a contour with a predetermined cross-sectional shape to be manufactured. In the following description, roll bending is also included in "roll forming".

Examples of a method of manufacturing a frame component using roll forming include a roll assembly disclosed in U.S. Pat. No. 4,080,815, for example. It is disclosed that this roll assembly enables a contour to be provided to a frame component with a cross-sectional shape, such as a T shape, an L shape, a Z shape, or a hat shape.

For example, Japanese Unexamined Patent Publication No. 2001-047260 discloses a manufacturing method for forming a component with a cross-sectional shape changing in its longitudinal direction, used for wings of an aircraft, so as to change its curvature. In this manufacturing method, at least one of side portions of an extruded molded material or the like is cut out and then the side portions are joined to each other by friction stir welding to form an integral component. When forming is performed so as to change curvature of the integral component, the integral component is formed by plastic forming after being joined. Examples of a method of the plastic forming include press forming, shot peening forming, creep forming, and the like.

SUMMARY OF THE INVENTION

The component with a cross-sectional shape changing in its longitudinal direction, disclosed in Japanese Unexamined Patent Publication No. 2001-047260, is used for wings or the like as described above. The component is manufactured using friction stir welding, and plastic forming is used to change curvature of the component.

In manufacturing of a frame component for an aircraft by roll forming, there has not been known a technique for continuously changing curvature of the frame component steplessly in a longitudinal direction of the frame component (providing continuous change in curvature). In particular, the frame component for an aircraft has a cross-sectional shape in which a side edge portion in the width direction is bent, such as an L shape, a hat shape, an S shape, or a Z shape, for example. It has been substantially difficult to appropriately adjust or control curvature of the frame component along its longitudinal direction so as to provide continuous curvature change to the frame component having a complicated cross-sectional shape as described above, for example.

The present invention is made to solve a problem as described above, and an object thereof is to provide an apparatus for and a method of manufacturing a roll-formed component, capable of favorably changing, adjusting, or controlling curvature of the roll-formed component along its longitudinal direction in the manufacturing of the roll-formed component.

An apparatus for manufacturing a roll-formed component, according to the present invention, manufactures a roll-formed component with curvature continuously changing along its longitudinal direction by applying roll bending to an elongated sheet or an elongated extrusion material, being a workpiece, along its longitudinal direction, to solve the problem described above. The apparatus includes a fulcrum roll that is provided upstream of the workpiece in a bending path to support the workpiece during bending, or to serve as a fulcrum of bending, a bending roll positioned downstream of the fulcrum roll in the bending path to apply bending to the workpiece, a roll moving unit that moves at least one of the fulcrum roll and the bending roll so as to relatively change a position of the bending roll with reference to a position of the fulcrum roll, and a control unit. Under the following conditions: a position allowing the fulcrum roll to be brought into contact with the workpiece is set as a fulcrum roll contact position; a position allowing the bending roll to be brought into contact with the workpiece is set as a bending roll contact position; when the roll-formed component is divided into a plurality of unit intervals in its longitudinal direction, a design value of a curvature radius of an unit portion corresponding to each of the unit intervals in the roll-formed component is set as a design curvature radius; a curvature radius applied to the workpiece at the fulcrum roll contact position is set as an initial curvature radius; and a curvature radius remaining in the workpiece when the workpiece is fed out from the bending roll contact position to achieve the design curvature radius in the roll-formed component is set as a final curvature radius, the initial curvature radius is set as a curvature radius to be applied to the workpiece before spring back occurs by applying bending to the workpiece. Under the following conditions: the unit portion positioned at the fulcrum roll contact position at the time when the workpiece is fed to a nip between the fulcrum roll and the bending roll is set as a fulcrum roll unit portion; the unit portion positioned at the bending roll contact position is set as a bending roll unit portion; and the unit portion positioned between the unit portions above, corresponding to each of the unit intervals, is set as an intermediate unit portion, the control unit integrates an amount of change in bending position in each of the intermediate unit portion and the bending roll unit portion when an intermediate curvature radius set so as to continuously change curvature of the intermediate unit portion from the initial curvature radius to the design curvature radius is applied to the intermediate unit portion, and the design curvature radius is applied to the bending roll unit portion, to apply the initial curvature radius corresponding to the unit portion to the fulcrum roll unit portion and apply the design curvature radius corresponding to the unit portion to the bending roll unit portion. The control unit causes the roll moving unit to be driven to move at least one of the fulcrum roll and the bending roll on the basis of an integrated value.

A method of manufacturing a roll-formed component, according to the present invention, is configured to manufacture a roll-formed component with curvature continuously changing along its longitudinal direction by applying roll bending to an elongated sheet or an elongated extrusion material, being a workpiece, along its longitudinal direction, to solve the problem described above. The method may include the steps of: supporting the workpiece during bending by a fulcrum roll provided upstream of the workpiece in a bending path, or allowing the fulcrum roll to serve as a fulcrum of bending; applying bending to the workpiece by a bending roll positioned downstream of the fulcrum roll in the bending path; moving at least one of the fulcrum roll and the bending roll so as to relatively change a position of the bending roll with reference to a position of the fulcrum roll by using a roll moving unit; setting a position allowing the fulcrum roll to be brought into contact with the workpiece as a fulcrum roll contact position; setting a position allowing the bending roll to be brought into contact with the workpiece as a bending roll contact position; setting a design value of a curvature radius of each of the unit intervals in the roll-formed component as a design curvature radius when the roll-formed component is divided into a plurality of unit intervals in its longitudinal direction; setting a curvature radius applied to the workpiece at the fulcrum roll contact position as an initial curvature radius; setting a curvature radius remaining in the workpiece when the workpiece is fed out from the bending roll contact position to achieve the design curvature radius in the roll-formed component as a final curvature radius; setting the initial curvature radius as a curvature radius to be applied to the workpiece before spring back occurs by applying bending to the workpiece; setting the unit portion positioned at the fulcrum roll contact position at the time when the workpiece is fed to a nip between the fulcrum roll and the bending roll as a fulcrum roll unit portion; setting the unit portion positioned at the bending roll contact position as a bending roll unit portion; setting the unit portion positioned between the unit portions above, corresponding to each of the unit intervals, as an intermediate unit portion; applying an intermediate curvature radius set so as to continuously change curvature of the intermediate unit portion from the initial curvature radius to the design curvature radius to the intermediate unit portion, to apply the initial curvature radius corresponding to the unit portion to the fulcrum roll unit portion and apply the design curvature radius corresponding to the unit portion to the bending roll unit portion; applying the design curvature radius to the bending roll unit portion; integrating an amount of change in bending position in each of the intermediate unit portion and the bending roll unit portion; and moving the roll moving unit, and at least one of the fulcrum roll and the bending roll using the roll moving unit on the basis of this integrated value.

According to the above configuration, a design curvature radius is preset for a position of the roll-formed component manufactured in its longitudinal direction, and the initial curvature radius being a curvature radius before spring back occurs is preset for the design curvature radius to form a database. The control unit integrates a relative amount of change in position of the bending roll based on an individual design curvature radius in each unit interval in a period from the fulcrum roll contact position to the bending roll contact position when a workpiece is fed out from the fulcrum roll, with reference to the database. The control unit controls the roll moving unit such that a relative positional change of the bending roll with respect to the fulcrum roll becomes an amount of change in position based on this integrated quantity.

In this configuration, not only the initial curvature radius is set by paying attention to the fulcrum roll contact position, but also a position of the bending roll with respect to the fulcrum roll is determined such that a workpiece advanced from the fulcrum roll contact position toward the bending roll contact position has a shape formed by accumulating a bending shape. This enables a relative position of the bending roll to the fulcrum roll to be gradually changed to provide a continuous curvature change to the workpiece. Thus, a portion with curvature continuously changing can be formed at a desired position in the roll-formed component obtained, in its longitudinal direction. As a result, a roll-formed component can be adjusted or controlled to have favorable curvature along its longitudinal direction in manufacturing thereof.

The present invention achieves an effect that enables providing an apparatus for and a method of manufacturing a roll-formed component, capable of favorably changing, adjusting, or controlling curvature of the roll-formed component along its longitudinal direction in the manufacturing of the roll-formed component, by using the above configuration.

The following detailed description of a preferred embodiment of the present invention, with reference to accompanying drawings, will reveal the above object, other objects, features, and advantages of the present invention.

DETAILED DESCRIPTION OF PREFERRED EMBODIMENTS

Figure 1:
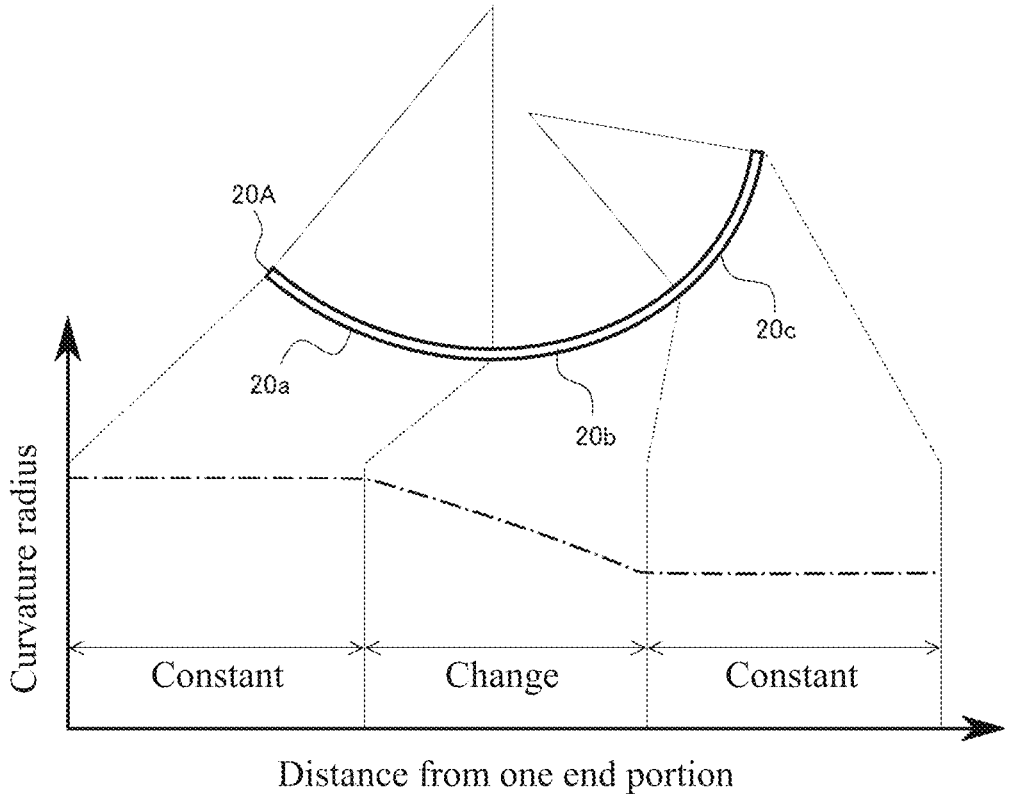
FIG. 1 is a diagram comparing a schematic plan view illustrating an example of a representative configuration of a roll-formed component according to the present disclosure with a change in curvature of the roll-formed component in its longitudinal direction.

Hereinafter, a representative embodiment of the present invention will be described with reference to the drawings. In the following description, the same or corresponding element is designated by the same reference numeral throughout the drawings to eliminate a duplicated description of the element.

[Workpiece and Roll-Formed Component]

First, a roll-formed component manufactured according to the present disclosure and a workpiece as a raw material before being formed into the roll-formed component will be specifically described with reference to FIGS. 1 to 3, and FIGS. 4A to 4E.

Figure 2:
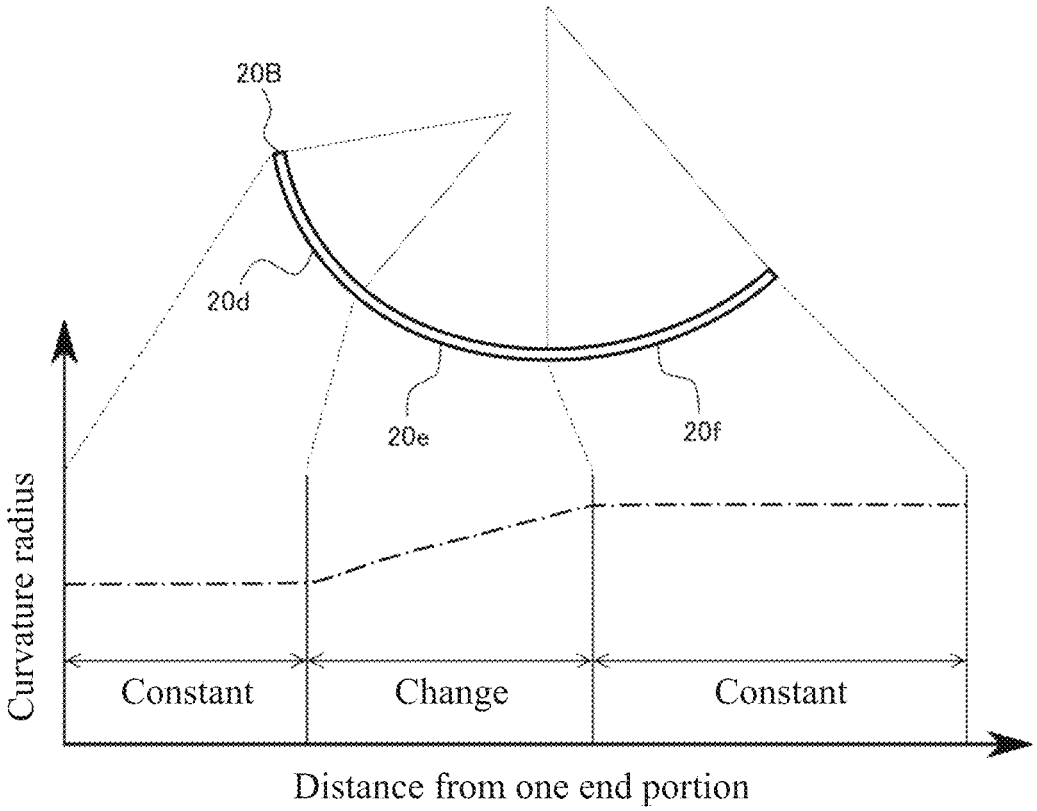
FIG. 2 is a diagram comparing a schematic plan view illustrating an example of another representative configuration of the roll-formed component according to the present disclosure with a change in curvature of the roll-formed component in its longitudinal direction.
Figure 3:
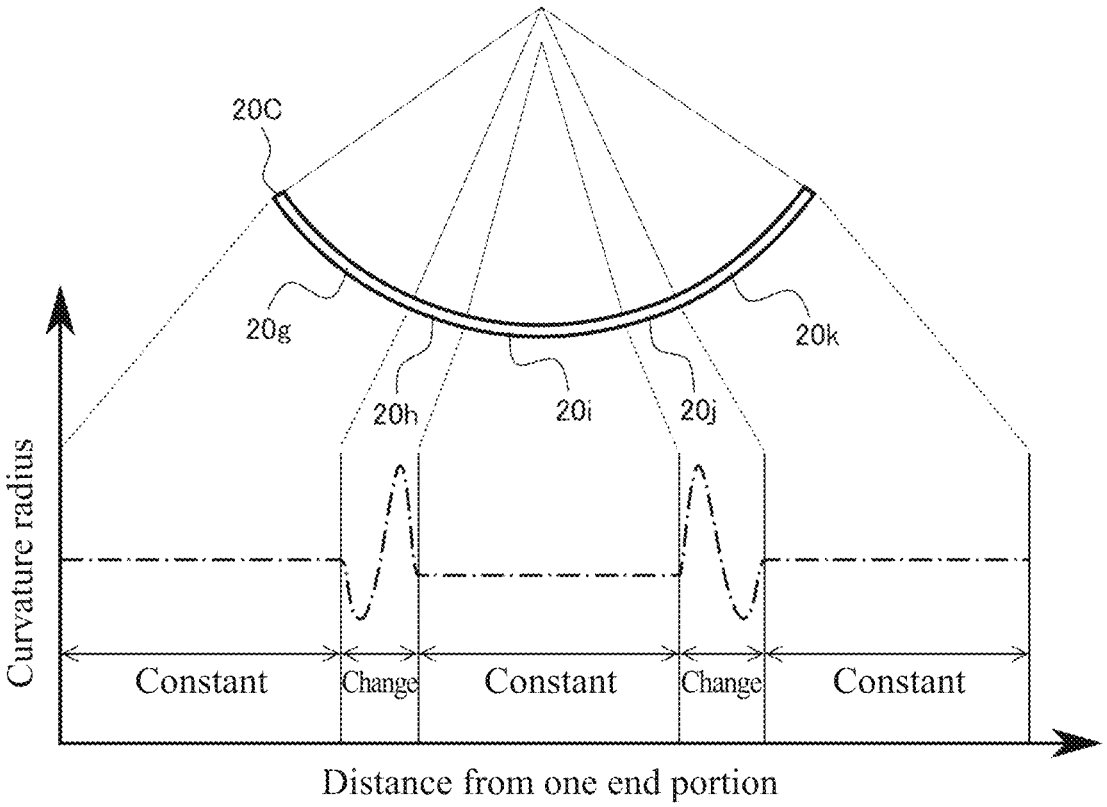
FIG. 3 is a diagram comparing a schematic plan view illustrating an example of yet another representative configuration of the roll-formed component according to the present disclosure with a change in curvature of the roll-formed component in its longitudinal direction.

In the present embodiment, a frame used in an aircraft fuselage in its cross-sectional direction (lateral direction) of various frame components used for manufacturing the aircraft fuselage is exemplified as a roll-formed component, for example. As illustrated in FIG. 1, 2 or 3, roll-formed components 20A to 20C (frames) each have a generally curved shape, and have a portion with curvature continuously changing in its longitudinal direction (a longitudinal direction of each of the roll-formed components 20A to 20C, or an axial direction of a material).

Specifically, the roll-formed component 20A illustrated in the upper diagram of FIG. 1 is provided in its both longitudinal end portions with constant-curvature portions 20*a* and 20*c* each curved with constant curvature. Between the constant-curvature portions 20*a* and 20*c*, there is provided a curvature-changing portion 20*b* that is curved such that its curvature continuously changes in its longitudinal direction from the constant curvature in the constant-curvature portion 20*a*.

The lower diagram of FIG. 1 is a graph illustrating change of a curvature radius corresponding to a position in the longitudinal direction of the roll-formed component 20A illustrated in the upper diagram of FIG. 1. The horizontal axis of this graph represents a distance from one end of the roll-formed component 20A, i.e., a longitudinal position of the roll-formed component 20A, and the vertical axis represents curvature radius at the position. In addition, each portion constituting the roll-formed component 20A illustrated in the upper diagram of FIG. 1 and a position (distance) on the horizontal axis in the graph illustrated in the lower diagram of FIG. 1 are associated with each other by a dotted line (the same applies to FIGS. 2 and 3 described below). The roll-formed component 20A illustrated in the upper diagram of FIG. 1 is configured such that the curvature radius in the curvature-changing portion 20*b* gradually decreases from the curvature radius of the constant-curvature portion 20*a* to connect to the constant-curvature portion 20*c* as illustrated in the lower diagram of FIG. 1 by a graph with a dashed line.

The roll-formed component 20B illustrated in the upper diagram of FIG. 2 is provided in its both longitudinal end portions with constant-curvature portions 20*d* and 20*f*. Between the constant-curvature portions 20*d* and 20*f*, there is provided a curvature-changing portion 20*e* that is curved such that its curvature continuously changes in its longitudinal direction from the constant curvature in the constant-curvature portion 20*d*. The roll-formed component 20B illustrated in the upper diagram of FIG. 2 is configured such that the curvature radius in the curvature-changing portion 20*e* gradually increases from the curvature radius of the constant-curvature portion 20*d* to connect to the constant-curvature portion 20*f* as illustrated in a graph of the lower diagram of FIG. 2.

In addition, the roll-formed component 20C illustrated in the upper diagram of FIG. 3 is provided in its both longitudinal end portions with constant-curvature portions 20*g* and 20*k*. A portion between the constant-curvature portions 20*g* and 20*k* is composed of a curvature-changing portion 20*h*, a constant-curvature portion 20*i*, and a curvature-changing portion 20*j*. For convenience of description, the curvature-changing portion 20*h* is referred to as a first curvature-changing portion 20*h*, and the curvature-changing portion 20*j* is referred to as a second curvature-changing portion 20*j*.

The roll-formed component 20C illustrated in the upper diagram of FIG. 3 is curved such that curvature radius of the first curvature-changing portion 20*h* continuously changes in its longitudinal direction from constant curvature in the constant-curvature portion 20*g*, and the second curvature-changing portion 20*j* is curved such that curvature thereof continuously changes in its longitudinal direction from constant curvature in the constant-curvature portion 20*i*, as illustrated in a graph of the lower diagram of FIG. 3. Thus, as viewed from the constant-curvature portion 20*g* constituting one end portion of the roll-formed component 20C, the roll-formed component 20C is formed by connecting the constant-curvature portion 20*g*, the first curvature-changing portion 20*h*, the constant-curvature portion 20*i*, the second curvature-changing portion 20*j*, and the constant-curvature portion 20*k*, in this order.

The curvature-changing portion 20*b* of the roll-formed component 20A illustrated in FIG. 1 and the curvature-changing portion 20*e* of the roll-formed component 20B illustrated in FIG. 2 have respectively curvature change gradually increasing along a longitudinal direction of the curvature-changing portion 20*b* and curvature change gradually decreasing along a longitudinal direction of the curvature-changing portion 20*e* (refer to the lower diagram of FIG. 1 and the lower diagram of FIG. 2). In contrast, as illustrated in graph of the lower diagram of FIG. 3, the first curvature-changing portion 20*h* in the roll-formed component 20C illustrated in FIG. 3 has a curvature radius that changes so as to once decrease along its longitudinal direction and then increase after reaching the minimum, and the second curvature-changing portion 20*j* has a curvature radius that changes so as to once increase along its longitudinal direction and then decrease after reaching the maximum.

The change in the curvature radius in each of the curvature-changing portions 20*b*, 20*e*, 20*h*, and 20*j* is not limited to the corresponding one of the examples illustrated in FIGS. 1 to 3 described above. Likewise, a specific configuration of each of the constant-curvature portions 20*a*, 20*c*, 20*d*, 20*f*, 20*g*, 20*i*, and 20*k* is also not particularly limited. While any of the examples illustrated in FIGS. 1 to 3 is formed in a curved (curved) shape having a constant curvature, a curvature radius may be infinite, i.e., linear, for example. In this case, the "constant-curvature portion" may be referred to as a "straight portion".

The position in the longitudinal direction of each of the roll-formed components 20A to 20C is referred to as a "component position", for convenience. As described below, the component position can be defined as an absolute position in the longitudinal direction (a length or a distance from one end) with respect to one end of each of the roll-formed components 20A to 20C (e.g., 0 mm).

When the roll-formed components 20A to 20C are collectively referred to as a roll-formed component 20, the cross-sectional shape of the roll-formed component 20 is not particularly limited, and may be a predetermined shape. Examples of a cross-sectional shape using a feature of roll forming include a shape in which both edges in a cross-sectional direction are bent in directions different from each other, i.e., a shape of "Z" in the alphabet (Z type), as illustrated in FIG. 4A, for example.

Figure 4A:
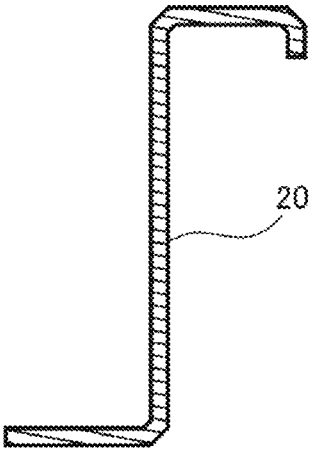
FIGS. 4A to 4E are each a schematic cross-sectional view illustrating a typical example of a transverse cross section of each of the roll-formed components illustrated in FIGS. 1 to 3.
Figure 4B:
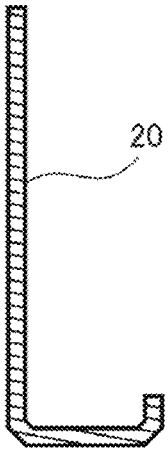
Figure 4C:
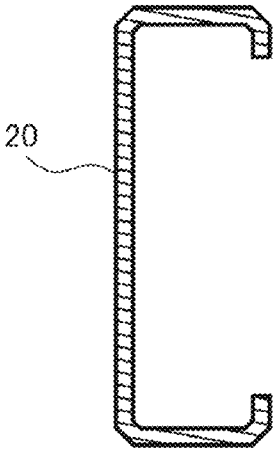
Figure 4D:
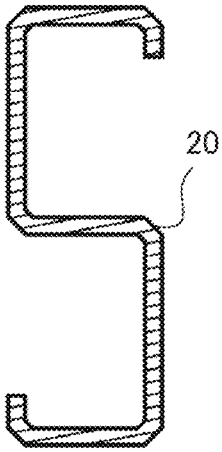
Figure 4E:
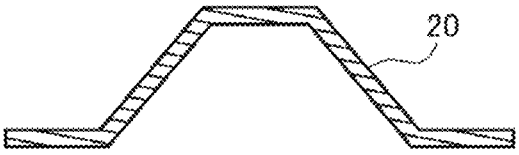

Alternatively, examples of the cross-sectional shape of the roll-formed component 20 may include the following: a shape in which one edge portion in a cross-sectional direction is bent, i.e., a shape of "L" in the alphabet (L type) as illustrated in FIG. 4B; a shape in which both edges in a cross-sectional direction is bent in the same direction, i.e., a shape of "C" in the alphabet (C type) as illustrated in FIG. 4C; a shape obtained by combining C types in directions opposite to each other (a shape in which both edges in a cross sectional direction are bent in directions opposite to each other and a central portion in the cross sectional direction is bent so as to face both edges), i.e., a shape of "S" in the alphabet (S type) as illustrated in FIG. 4D; and a shape obtained by protruding (or depressing) a central portion with respect to both edge portions in a cross sectional direction, i.e., a hat type (or a S2 type) as illustrated in FIG. 4E.

In other words, examples of a cross-sectional shape using a feature of roll forming include a shape (Z type, L type, C type or the like) in which at least one edge portion in a cross sectional direction is bent, or a shape bent at a central portion in the cross sectional direction (e.g., a hat type), or a combination thereof (S type or the like). As a matter of course, it is needless to say that the cross-sectional shape of the roll-formed component 20 may be other than the shapes illustrated in FIGS. 4A to 4E.

Further, while only one edge portion (upper side in the drawing) of both edge portions in the cross-sectional direction is bent inward further in the Z type cross-sectional shape illustrated in FIG. 4A, a cross-sectional shape of the Z type roll-formed component 20 is not limited thereto. For example, only the other edge portion may be further bent, or the outer edges of respective both edge portions may be bent. Likewise, a further bent portion may or may not be formed in the edge portion of the L type illustrated in FIG. 4B, the C type illustrated in FIG. 4C, or the S type illustrated in FIG. 4D.

In addition, when the cross-sectional shape of each of the roll-formed components 20A to 20C illustrated in FIGS. 1 to 3 is a Z type, for example, any portion in the longitudinal direction may have a cross-sectional shape of the same Z type (refer to FIG. 4A), for example. However, the roll-formed component 20 manufactured according to the present disclosure is not limited to this, and may have a different sectional shape (having a flexible cross-sectional shape) for each portion in the longitudinal direction. For convenience of description, the former is referred to as a "uniform cross-section molded component", and the latter is referred to as a "flexible cross-section molded component".

In addition, a material of the roll-formed component 20 is also not particularly limited. When the roll-formed component 20 is an aircraft component such as a frame, examples of the material of roll-formed component 20 include aluminum and an alloy thereof (aluminum-based material). When it is a component used in other fields, the examples thereof include an iron-based material such as steel or the like (iron or an alloy containing iron).

When the roll-formed component 20 has a flexible cross-sectional shape, cross-sectional rigidity may be different depending on a cross-sectional shape. In addition, when the same curvature is formed in the roll-formed component 20 in the same shape using the same roll bending apparatus, a different material causes a difference in section rigidity even in the same shape and curvature. Examples of a difference in the material include a difference in a metal material serving as a main component, such as a difference between an aluminum-based material and an iron-based material, for example. In addition, even a plurality of alloy materials each classified as an aluminum-based material may cause different sectional rigidity depending on a kind of alloy or the like. As described above, the roll-formed component 20 manufactured according to the present disclosure has different cross-sectional rigidity, such as caused by a different cross-sectional shape from the middle in the longitudinal direction of the roll-formed component 20, or a different material used from the middle therein.

When the roll-formed component 20 is a component for an aircraft, a specific example of the roll-formed component 20 is not limited to the frame, and examples thereof include a stringer, a stiffener, a spar, a floor beam, a rib, a frame, and the like. While these components are each a frame component of the aircraft, the roll-formed component 20 is not limited to such a frame component, and may be another aircraft component. In addition, the roll-formed component 20 manufactured according to the present disclosure is not limited to an aircraft component, and can also be suitably used for a component having curvature used in another field such as the automobile field or the building material field.

In the present disclosure, the roll-formed component 20 may be manufactured by forming curvature (providing curvature) to an elongated extrusion (long extrusion) material in which a predetermined cross-sectional shape is previously formed, or a flat elongated sheet (long sheet) before a predetermined cross-sectional shape is formed may be subjected to a step of forming a predetermined cross-sectional shape followed by continuously a step of forming curvature, for example. In the present disclosure, when the "roll-formed component 20" as illustrated in FIGS. 1 to 3 is defined as a "component (or member) provided with curvature", a "component (or member) before curvature is formed)" is referred to as a "workpiece", for convenience.

When other known processing is performed on the roll-formed component 20 in addition to forming of a cross-sectional shape and forming of curvature, the "workpiece" includes not only a sheet material (or raw material) that is not subjected to any processing, but also a sheet material that is already subjected to processing other than curvature-forming processing. Forming of a cross-sectional shape or another processing other than this may be performed by a known method. In particular, the forming of a cross-sectional shape can be performed by known roll forming along with the forming of curvature in the present disclosure.

[Apparatus for Manufacturing Roll-Formed Component]

Next, an apparatus for manufacturing a roll-formed component according to the present embodiment will be described in detail with reference to FIGS. 5A and 5B.

Figure 5A:
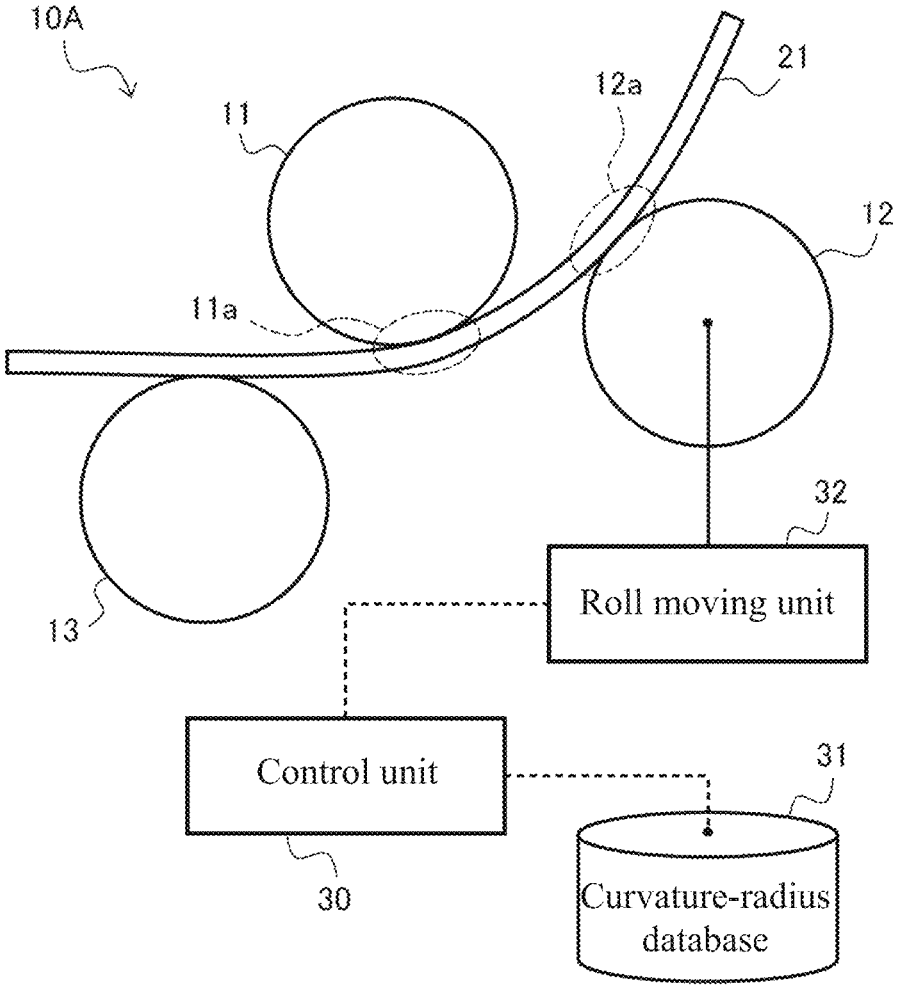
FIG. 5A is a schematic view illustrating an example of an apparatus for manufacturing a roll-formed component according to an embodiment of the present disclosure.

As illustrated in FIG. 5A, a roll-formed component manufacturing apparatus 10A (hereinafter simply referred to as a "manufacturing apparatus 10A") according to the present embodiment includes a fulcrum roll 11, a bending roll 12, a feeding roll 13, a control unit 30, a curvature-radius database 31, a roll moving unit 32, and the like. The manufacturing apparatus 10A includes at least the fulcrum roll 11 and the bending roll 12, and manufactures the roll-formed component 20 described above by applying roll bending to an elongated extrusion material 21, for example, being a workpiece along its longitudinal direction. In the manufacturing apparatus 10A, a path through which the elongated extrusion material 21 is fed (conveyed) and subjected to roll bending is referred to as a bending path.

The fulcrum roll 11 is positioned upstream of the bending roll 12 in the bending path, and supports the elongated extrusion material 21 during bending or serves as a fulcrum of bending of the elongated extrusion material 21. The bending roll 12 is positioned downstream of the fulcrum roll 11 in the bending path, and is configured to be movable with respect to a position of the fulcrum roll 11. Moving the bending roll 12 enables bending to be applied to the elongated extrusion material 21 at a position of the fulcrum roll 11.

The feeding roll 13 is positioned upstream of the fulcrum roll 11 in the bending path, and feeds out (conveys) the elongated extrusion material 21 toward the fulcrum roll 11. Thus, in the manufacturing apparatus 10A, the feeding roll 13, the fulcrum roll 11, and the bending roll 12 are positioned in this order from upstream of the bending path. The bending path between the fulcrum roll 11 and the bending roll 12 is referred to as an "inter-roll path", for convenience of description.

A specific configuration of each of the fulcrum roll 11, the bending roll 12, and the feeding roll 13 is not particularly limited, and various forming rolls known in the field of a roll bending apparatus can be used. For example, while any one of the fulcrum roll 11, the bending roll 12, and the feeding roll 13 is a single roll in the configuration illustrated in FIG. 5A, at least one of the rolls may be a pair of rolls composed of two rolls facing each other as illustrated in a modified example described below.

The control unit 30 controls operation of the manufacturing apparatus 10A. In particular, operation of the roll moving unit 32 is controlled with reference to the curvature-radius database 31 in the present embodiment, as described below. The curvature-radius database 31 stores a design value of a curvature radius (or curvature) and the like as a database to apply a desired curvature radius (or curvature) to the elongated extrusion material 21 being a workpiece. The roll moving unit 32 moves at least one of the fulcrum roll 11 and the bending roll 12 so as to relatively change a position of the bending roll 12 with reference to a position of the fulcrum roll 11.

In the present embodiment, the fulcrum roll 11 is fixed in position, and only the bending roll 12 is configured to be moved by the roll moving unit 32. The bending roll 12 is configured to be moved by stroke movement in a direction (e.g., a vertical direction) intersecting a bending path (a feeding (conveying) direction or a feeding-out direction of a workpiece).

The movement of the bending roll 12 is not limited to one-dimensional movement such as the stroke movement, and may be two-dimensional movement. Even when the fulcrum roll 11 is movable, its movement may be stroke movement or two-dimensional movement, like the movement of the bending roll 12. In addition, when the bending roll 12 is a pair of rolls composed of two rolls facing each other as in a modification described below, it is preferable that this pair of rolls includes a rotating shaft for rotating the pair of rolls itself so as to always be a direction (e.g., a substantially vertical direction) intersecting the bending path (workpiece) even with a stroke.

In FIG. 5A, a position at which the fulcrum roll 11 is brought into contact with the elongated extrusion material 21 (workpiece) is defined as a fulcrum roll contact position 11*a*, for convenience. Likewise, a position at which the bending roll 12 is brought into contact with the elongated extrusion material 21 is defined as a bending roll contact position 12*a*, for convenience. Each of the fulcrum roll contact position 11*a* and the bending roll contact position 12*a* is illustrated in FIG. 5A as a region surrounded by a short broken line.

A specific configuration of each of the control unit 30, the curvature-radius database 31, and the roll moving unit 32 is not particularly limited, and a control configuration or a moving mechanism well-known in the field of a roll bending apparatus can be suitably used. For example, the control unit 30 may be composed of a microcomputer, or a CPU of a microcontroller. The curvature-radius database 31 may be configured as a storage unit that can be read out by a microcomputer or a microcontroller. The storage unit may be built in the manufacturing apparatus 10A or may be externally connected.

The roll moving unit 32 may be a known actuator or the like capable of changing a position of the forming roll, or may be configured to be capable of moving the roll 12 along a known linear guide or the like. For example, a direction in which bending is applied to the elongated extrusion material 21 by the bending roll 12 is defined as a first direction. At this time, the roll moving unit 32 can move the bending roll 12 in X-X direction by providing a linear guide or the like along X-X direction being the first direction as illustrated in FIG. 5B.

When the bending roll 12 is in contact with the elongated extrusion material 21 during forming, a substantially normal direction at the contact portion, i.e., a substantially normal direction at the roll contact position 12*a* is defined as a second direction. At this time, the roll moving unit 32 can move the bending roll 12 in not only X-X direction but also Y-Y direction by providing a linear guide or the like along Y-Y direction being the second direction as illustrated in FIG. 5B.

In addition, when a distance between the fulcrum roll contact position 11*a* and the bending roll contact position 12*a* is changed, setting of an unit interval or calculation of a curvature radius may be complicated to divide the roll-formed component 20 into a plurality of unit intervals in its longitudinal direction, or to calculate the curvature radius to be applied to the elongated extrusion material 21, for example, as described below. Thus, to adjust a distance between the fulcrum roll contact position 11*a* and the bending roll contact position 12*a*, the roll moving unit 32 may be configured so as to move the bending roll 12 in its rotation direction.

Figure 5B:
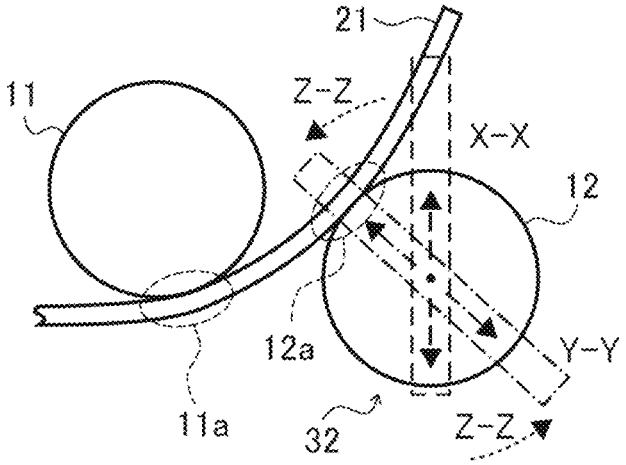
FIG. 5B is a schematic view illustrating an example of a moving direction of a roll moving unit of the apparatus for manufacturing a roll-formed component illustrated in FIG. 5A.

For example, when the roll moving unit 32 is configured to be capable of moving the bending roll 12 in X-X direction being the first direction and Y-Y direction being the second direction, the roll moving unit 32 may be configured to be capable of further moving the bending roll 12 in Z-Z direction, as illustrated in FIG. 5B. This Z-Z direction may be a direction (rotation direction) in which the bending roll 12 is rotated to move its position (this rotation direction is not a direction of rotation of the bending roll 12).

FIG. 5A illustrates the roll moving unit 32 as a functional block. FIG. 5A also illustrates the block of the roll moving unit 32 and the bending roll 12 while they are connected by a solid line segment. This schematically shows that the roll moving unit 32 is configured to be capable of moving the bending roll 12. In addition, FIG. 5A illustrates the block of the control unit 30 and a block of each of the curvature-radius database 31 and the roll moving unit 32 while they are connected by dotted line segments. This schematically shows that the control unit 30 reads out data from the curvature-radius database 31, and controls the roll moving unit 32.

In the present embodiment, the curvature-radius database 31 stores at least three kinds of curvature radius data on the design curvature radius, the initial curvature radius, and the intermediate curvature radius, based on a component position (a position of the roll-formed component 20 in its longitudinal direction). The curvature-radius database 31 may also store another data on a curvature radius. These curvature radii are each set to a portion corresponding to a predetermined component position of the roll-formed component 20.

Figure 6A:
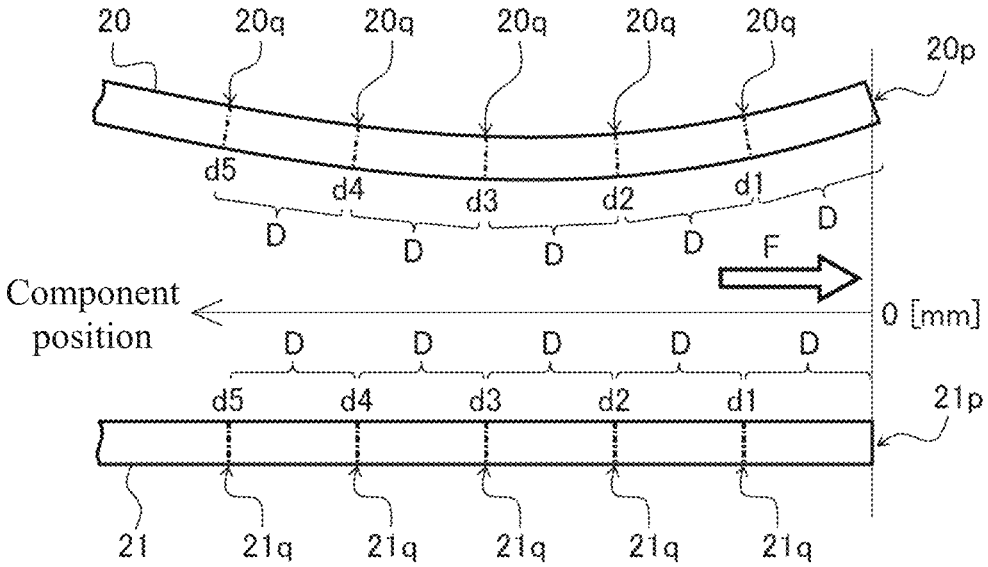
FIG. 6A is a schematic view for illustrating an absolute position of a roll-formed component and a workpiece.

First, the design curvature radius will be described. For example, it is assumed that the roll-formed component 20 is divided into a plurality of unit intervals D in its longitudinal direction as illustrated in FIG. 6A. In FIG. 6A, one end of the roll-formed component 20 on its downstream side in a feeding direction (indicated by a block arrow in FIG. 6A) is defined as a "reference end 20*p*". The reference end 20*p* is 0 mm as a component position. The unit interval D is set as a constant distance between the corresponding component positions at d1 mm, d2 mm, d3 mm, d4 mm, d5 mm, . . . . The design curvature radius is a design value of curvature radius of a unit portion 20*q* corresponding to each unit interval D in the roll-formed component 20.

The "unit portion 20*q*" means a portion (part) corresponding to each unit interval in the roll-formed component 20. While setting of the unit portion 20*q* is not particularly limited, a component position on an upstream side in the feeding direction (an opposite side to the reference end 20*p*, or the other end side) of component positions at respective opposite ends of the unit interval D is set as the unit portion 20*q* of the unit interval D in the example illustrated in FIG. 6A. Specifically, in the first unit interval D from the reference end 20*p*, a portion corresponding to a component position at d1 mm corresponds to the unit portion 20*q* of the unit interval, as illustrated in FIG. 6A. In the second unit interval D from the reference end 20*p*, a portion corresponding to a component position at d2 mm corresponds to the unit portion 20*q* of the unit interval D. The design curvature radius of each unit interval D is set for the corresponding one of the unit portions 20*q*.

While the roll-formed component 20 is a member (a formed member, or a formed product) subjected to bending by the manufacturing apparatus 10A, the unit interval D can be set to not only the roll-formed component 20, but also the elongated extrusion material 21 that is a "workpiece (or raw material)" before the bending is applied, as illustrated in FIG. 6A. Thus, the reference end 21*p* is defined also in the elongated extrusion material 21, as with the roll-formed component 20. An absolute position from the reference end 21*p* is a component position, a portion 21*q* corresponding to an appropriate component position is defined as a unit portion 21*q*, and a unit interval D is set as a constant distance between the corresponding component positions.

Thus, in the description below, terms (definitions) of the "component position", the "unit interval D", and the "unit portion 20*q*" are applied to not only the roll-formed component 20 that is a formed member, but also the elongated extrusion material 21 in the middle of bending with the manufacturing apparatus 10A.

Here, a predetermined distance (interval) is formed between the fulcrum roll 11 and the bending roll 12 as illustrated in FIG. 5A. The elongated extrusion material 21 during the bending is fed in the inter-roll path between the fulcrum roll 11 and the bending roll 12. To apply a predetermined curvature radius to an appropriate component position 20*q*, it is necessary to define not only an absolute position (component position 20*q*) of the elongated extrusion material 21 (roll-formed component 20) in its longitudinal direction, but also a relative position between the fulcrum roll 11 and the bending roll 12.

Figure 6B:
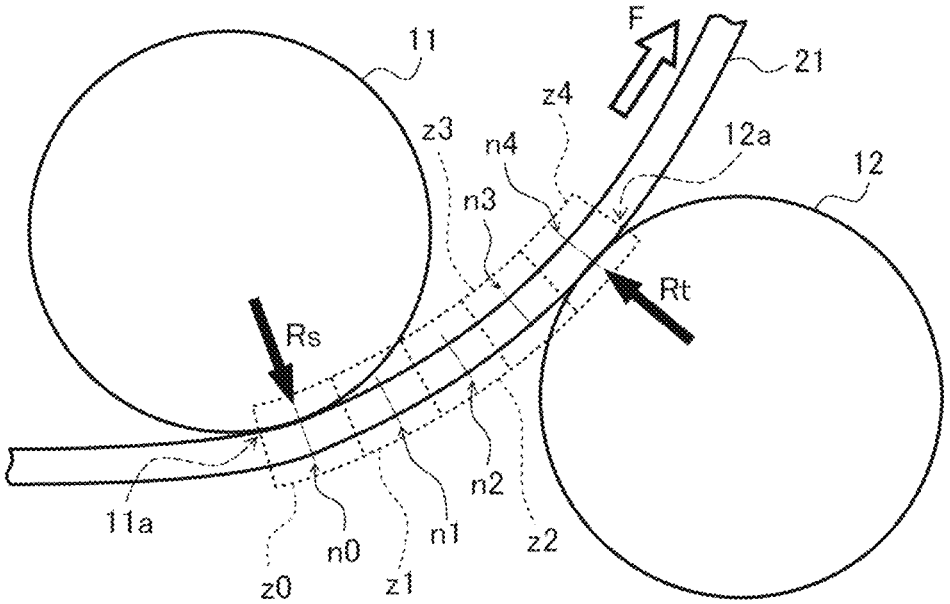
FIG. 6B is a schematic view for illustrating a relative position and a relative section between a support roll and a bending roll in the apparatus for manufacturing a roll-formed component illustrated in FIG. 5A.

When a distance between the fulcrum roll contact position 11*a* and the bending roll contact position 12*a* (i.e., the length of the inter-roll path) is abbreviated as a "roll interval" for convenience of description, an ideal contact point at which the fulcrum roll 11 is in contact with the elongated extrusion material 21, in the fulcrum roll contact position 11*a*, can be defined as a "start position Rs" (a black block arrow Rs) of the roll interval as illustrated in FIG. 6B. In addition, an ideal contact point at which the bending roll 12 is in contact with the elongated extrusion material 21, in the bending roll contact position 12*a*, can be defined as an "end position Rt" (a black block arrow Rt) of the roll interval.

A distance (roll interval) from the start position Rs to the end position Rt is divided into a plurality of intervals (lower intervals) each of which is the same as the unit interval D. The number of divisions of the roll interval (the number of lower intervals) is not particularly limited, and the roll interval is divided into four lower intervals in the example illustrated in FIG. 6B. Specifically, the start position Rs is set as a "relative position n0" and the end position Rt is set as a "relative position n4", and "relative positions n1 to n3" at equal intervals are set between them. An interval (lower interval) between the corresponding adjacent relative positions n0 to n4 may be the same as the unit interval D of the elongated extrusion material 21 (roll-formed component 20).

In other words, the inter-roll path between the fulcrum roll 11 and the bending roll 12 is divided at equal intervals of an integer to set the plurality of relative positions, for example, on the basis of a specific configuration of the manufacturing apparatus 10A, and the unit interval D of each of the roll-formed component 20 and the elongated extrusion material 21 can be set to be identical to the interval between the adjacent relative positions. While the reference sign of "20*q*" is attached in FIG. 6A for convenience of description of the "unit portion", the unit portion of the elongated extrusion material 21 is not illustrated in FIGS. 6B and 7 and the like referred to in the description below, for convenience of illustrating the relative positions n0 to n4. In the description with reference to FIG. 7 and the like, the "unit portion" is not designated by the reference sign "20*q*".

Here, the relative positions n0 to n4 are set with respect to the ideal contact point at which the fulcrum roll 11 and the bending roll 12 are brought into contact with the elongated extrusion material 21. However, in the actual bending, the fulcrum roll 11 and the bending roll 12 are required to be brought into contact with the elongated extrusion material 21 in a "line" or a predetermined "section" (or a part of the section) instead of at a "point". Thus, as illustrated in FIG. 6B, the division of the roll interval can also be set as each of "relative sections z0 to z4" (corresponding to the lower intervals), surrounded by dotted lines in FIG. 6B, instead of each of the relative positions n0 to n4, being an ideal "point".

The relative section z0 is set as a section having the center point of the start position Rs of the roll interval, and a distance of this section may be the same as the unit interval D of the elongated extrusion material 21 (roll-formed component 20). Likewise, in the example illustrated in FIG. 6B, the relative sections z1 to z4 having the relative positions n1 to n4 as the center points, respectively, can be set (thus, the relative section z4 is set as a section having the end position Rt of the roll interval as its center point). The relative sections z1 to z4 each may have the same distance as the unit interval D, as with the relative section z0.

Next, the initial curvature radius will be described. The initial curvature radius is a value of a curvature radius to be applied to a workpiece such as the elongated extrusion material 21 at the fulcrum roll contact position 11*a*. Specifically, the initial curvature radius is preliminarily calculated to be a desired curvature radius (i.e., the same value of the design curvature radius) after the elongated extrusion material 21 passes through the bending roll contact position 12*a*, i.e., after being spring-backed or after bending moment is released. The initial curvature radius is set as a value of a curvature radius to be applied to a workpiece before spring back is caused by bending applied to the workpiece or before strain is reduced.

In addition, a curvature radius remaining in the workpiece when the workpiece such as the elongated extrusion material 21 or the like is fed out from the bending roll contact position 12*a* is defined as a final curvature radius. As described above, a specific design curvature radius is preset in each unit portion in the roll-formed component 20, so that a specific value of a design curvature radius is achieved in each unit portion in the roll-formed component 20 actually manufactured. Thus, the design curvature radius ideally may be substantially the same as the final curvature radius, or the final curvature radius may be approximate to the design curvature radius within a range of accuracy of the curvature radius required for the roll-formed component 20.

When the workpiece such as the elongated extrusion material 21 is fed out from the fulcrum roll 11, the curvature radius of the elongated extrusion material 21 smoothly changes in the section from the fulcrum roll contact position 11*a* to the bending roll contact position 12*a*. Specifically, the curvature radius applied to the elongated extrusion material 21 smoothly changes from the initial curvature radius at the time when the elongated extrusion material 21 passes through the fulcrum roll 11 to the final curvature radius at the time when it passes through the bending roll 12, as described later, in the same unit portion of the roll-formed component 20. Thus, in consideration of this smooth change in the curvature radius, an individual value of the design curvature radius is set in each unit portion.

Specific values of the design curvature radius are set in all unit portions of the roll-formed component 20, so that specific values of the initial curvature radius corresponding to the specific values of the design curvature radius are also set. A set of these specific values of the curvature radius is prepared in the curvature-radius database 31.

Next, the intermediate curvature radius will be described. As described above, bending is applied to the elongated extrusion material 21 at the fulcrum roll contact position 11*a* by movement of the bending roll 12. However, a predetermined distance (roll interval) is formed between the fulcrum roll 11 and the bending roll 12 as described above, and the elongated extrusion material 21 is fed from the fulcrum roll contact position 11*a* to the bending roll contact position 12*a*. Thus, in the inter-roll path of the bending path, a stress is also applied from the bending roll 12 to a portion to which bending is applied at the fulcrum roll contact position 11*a*.

As described above, the fulcrum roll 11 and the bending roll 12 are positioned at a predetermined roll interval. Thus, as described below, an arbitrary portion of the elongated extrusion material 21 to which bending is applied by the fulcrum roll 11 gradually changes in strain or bending moment acting, while the elongated extrusion material 21 is fed along the inter-roll path to travel toward the bending roll contact position 12*a*. This requires the "intermediate curvature radius" in consideration of change in strain or bending moment to be set for the unit portion positioned in the inter-roll path.

The intermediate curvature radius may be set such that a curvature radius continuously changes from the initial curvature radius to the design curvature radius in each of the unit portions, from the fulcrum roll contact position 11*a* to the bending roll contact position 12*a*. While a specific method of setting the intermediate curvature radius is not particularly limited, the intermediate curvature radius can be set from a value of the initial curvature radius applied to an arbitrary unit portion when it is at the fulcrum roll contact position 11*a*, and strain or bending moment that changes until the unit portion reaches the bending roll contact position 12*a*, in the present embodiment.

Typically, strain or bending moment in a unit portion of the elongated extrusion material 21 decreases gradually (temporarily) toward a unit portion closer to the bending roll contact position 12*a*. Thus, the intermediate curvature radius may be set on the basis of the initial curvature radius applied at the fulcrum roll contact position 11*a* and a degree of reduction in strain or bending moment.

The control unit 30 integrates the amount of change in bending position of each unit portion from the fulcrum roll contact position 11*a* to the bending roll contact position 12*a* when a workpiece such as the elongated extrusion material 21 is fed out from the fulcrum roll 11, with reference to the curvature-radius database 31, to calculate "the amount of roll movement" as the amount of movement of the bending roll 12. The amount of change will be described below. The control unit 30 causes the roll moving unit 32 to move at least one of the fulcrum roll 11 and the bending roll 12 on the basis of this integrated quantity (the amount of roll movement). In the configuration illustrated in FIG. 5A, only the bending roll 12 is moved on the basis of the integrated quantity. This enables the roll-formed component 20 obtained to be provided at a desired position in its longitudinal direction with a portion where curvature changes continuously.

[Example of Control of Roll Moving Unit with Control Unit]

Figure 7:
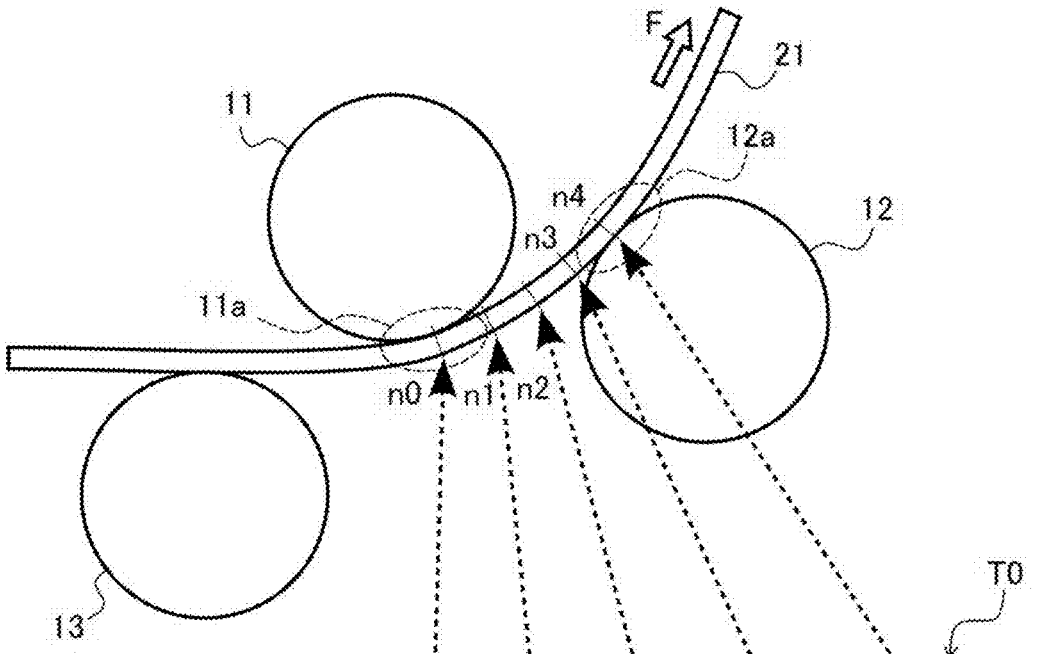
FIG. 7 is a schematic view illustrating an example of control by a control unit in the apparatus for manufacturing a roll-formed component illustrated in FIG. 5A.
Figure 8:
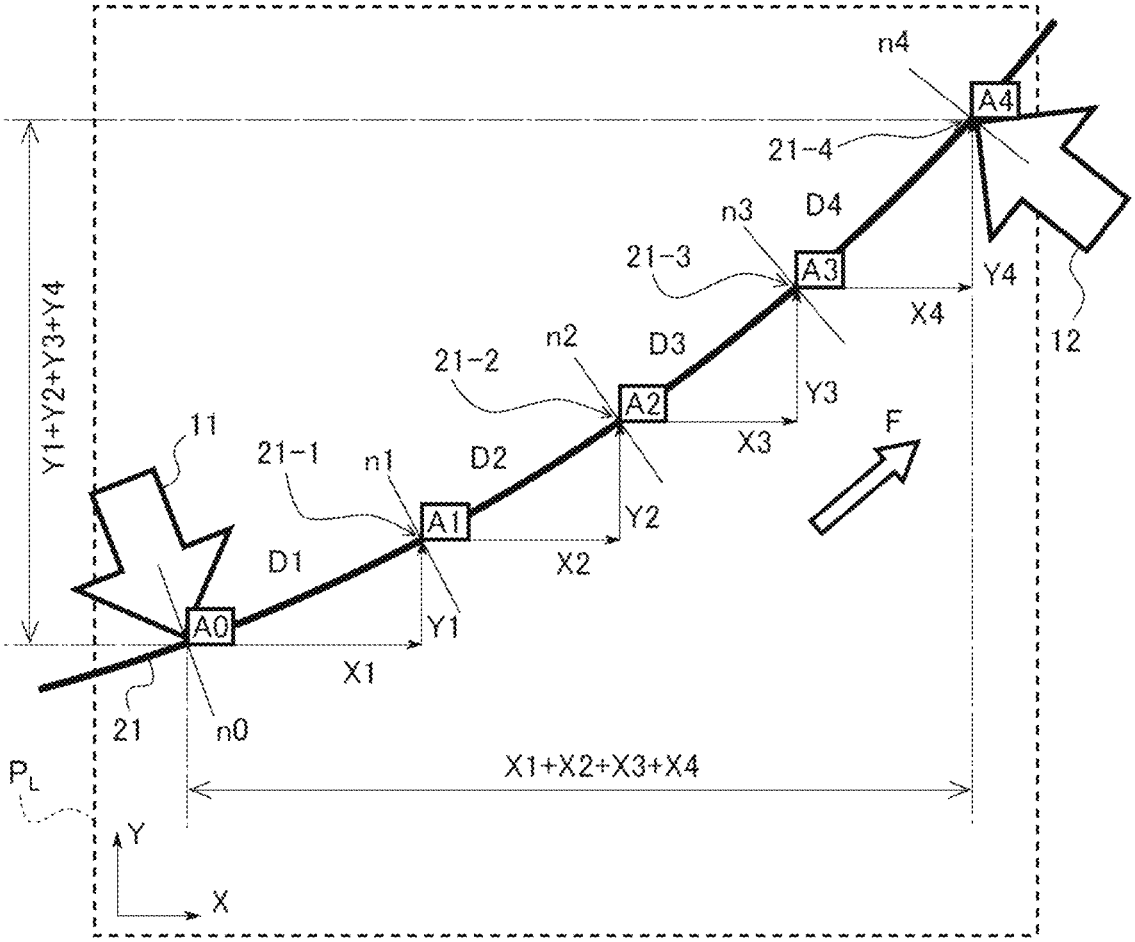
FIG. 8 is a schematic view illustrating an example of calculation of the amount of change in position of the bending roll under control of the control unit in the apparatus for manufacturing a roll-formed component illustrated in FIG. 5A.

Next, with reference to FIGS. 7 and 8, there is specifically described a configuration formed by the manufacturing apparatus 10A according to the present embodiment, in which the control unit 30 causes the roll moving unit 32 to change a relative position of the bending roll 12 with respect to the fulcrum roll 11 to form the curvature-changing portion 20*b* (refer to FIG. 1), the curvature-changing portion 20*e* (refer to FIG. 2), the first curvature-changing portion 20*h*, or the second curvature-changing portion 20*j* (refer to FIG. 3) in the roll-formed component 20 obtained.

For example, it is assumed that the elongated extrusion material 21 being a workpiece is fed out from the fulcrum roll 11 toward the bending roll 12 (toward the feeding direction indicated by the block arrow F) as illustrated in FIG. 7 (the same as the state illustrated in FIG. 5A). At this time, the relative positions n0 to n4 are set between the fulcrum roll contact position 11*a* and the bending roll contact position 12*a* so that the roll intervals are equally divided as described above. A distance between the corresponding adjacent relative positions n0 to n4 is the same distance (interval) as the unit interval D as described above. Instead of the relative positions n0 to n4, the relative sections z0 to z4 may be set (refer to FIG. 6B).

As described above, a plurality of unit intervals D is each set for the elongated extrusion material 21 so as to be the same distance as the distance between the corresponding adjacent relative positions n0 to n4 set by equally dividing the roll interval (refer to FIG. 6A). As described above, a setting curvature radius, the initial curvature radius, and the intermediate curvature radius are set in the corresponding unit portions (refer to FIG. 6A) each corresponding to the unit interval D.

In the example illustrated in FIG. 7, the roll interval is divided into four portions in a schematic manner with the same interval as the unit interval D. Thus, a total of five relative positions including the fulcrum roll contact position 11*a* and the bending roll contact position 12*a* are schematically set in this roll interval. In FIG. 7, when the fulcrum roll contact position 11*a* is set as the relative position n0, the relative position n1, the relative position n2, the relative position n3, and the relative position n4 are set for each unit interval D toward a downstream side of the bending path, in the roll interval. The relative position n4 corresponds to the bending roll contact position 12*a*.

For the roll-formed component 20, the design curvature radius is set in the unit portion for each unit interval D. While a specific numerical value of the unit interval D is not particularly limited, one unit interval D is set to 10 mm, for example, in the present embodiment. In the lower diagram of FIG. 7, an example of data such as a design curvature radius, an initial curvature radius, and an intermediate curvature radius, stored as the curvature-radius database 31 is shown as a table T0.

As illustrated in FIG. 7, at an arbitrary point in time when the elongated extrusion material 21 is fed to the inter-roll path, an arbitrary unit portion is positioned at the fulcrum roll contact position 11*a*, and another unit portion positioned downstream in the feeding direction F is positioned at the bending roll contact position 12*a*. In addition, a plurality of unit portions (three unit portions in FIG. 7) is positioned between the fulcrum roll contact position 11*a* and the bending roll contact position 12*a* (inter-roll path).

Then, for the convenience of description, a unit portion positioned at the fulcrum roll contact position 11*a* is defined as a "fulcrum roll unit portion", and a unit portion positioned at the bending roll contact position 12*a* is defined as a "bending roll unit portion". In addition, unit portions each corresponding to a unit interval, positioned between the fulcrum roll unit portion and the bending roll unit portion, are referred to as an "intermediate unit portion". In the example illustrated in FIG. 7, the unit portion positioned at the relative position n0 is the "fulcrum roll unit portion", the unit portion positioned at the relative position n4 is the "bending roll unit portion", and the unit portions positioned at the respective relative position n1 to n3 are each the "intermediate unit portion".

As described above, the roll interval is divided into a plurality of intervals each having the same length as the unit interval D. Thus, the intermediate unit portion positioned at the relative position n1 corresponds to the first unit interval D as viewed from the relative position n0, the intermediate unit portion positioned at the relative position n2 corresponds to the second unit interval D as viewed from the relative position n0, and the intermediate unit portion positioned at the relative position n3 corresponds to the third unit interval D as viewed from the relative position n0.

In the course of being fed to the inter-roll path, arbitrary unit portions of the elongated extrusion material 21 become the fulcrum roll unit portion, the plurality of intermediate unit portions, and the bending roll unit portion. In other words, it can be considered that the same unit portion sequentially is moved to the fulcrum roll unit portion, the intermediate unit portion, and the bending roll unit portion during conveyance (feed) of the elongated extrusion material 21. When an arbitrary unit portion is the fulcrum roll unit portion, an initial curvature radius having a value corresponding to the component position of the unit portion is applied, and when the unit portion is the bending roll unit portion, the design curvature radius having a value corresponding to the component of the unit portion is applied.

In addition, when an arbitrary unit portion is the intermediate unit portion, its curvature radius is an intermediate curvature radius having a value continuously changing from the value of the initial curvature radius when the arbitrary unit portion is the fulcrum roll unit portion to the value of the design curvature radius when the arbitrary unit portion is bending roll unit portion. In Table T0 exemplified in FIG. 7, the initial curvature radius, the design curvature radius, and the intermediate curvature radius at an arbitrary unit portion (component position) of the elongated extrusion material 21 (roll-formed component 20) are summarized.

Specifically, Table T0 exemplifies a total of six component positions for every 10 mm from the component position of 1000 mm (1000 mm, 1010 mm, 1020 mm, 1030 mm, 1040 mm, and 1050 mm), so that a total of five unit intervals D1 to D5 are each exemplified as the unit interval D. FIG. 7 illustrates the unit intervals D5, D4, D3, D2, and D1 from the downstream side in the feeding direction F (a side with a smaller numerical value of the component position).

In the present embodiment, the unit portions corresponding to the unit intervals D1 to D5 are set to the component positions on the respective downstream sides of the corresponding unit intervals D1 to D5 as described above. For example, the unit interval D1 in Table T0 is between component positions of 1040 mm and 1050 mm, and the component position of the elongated extrusion material 21 corresponding to the unit interval D1 is the unit portion of 1040 mm on the downstream side.

Table T0, in order from the left in FIG. 7, includes a column ("component" in FIG. 7) of the component position (unit portion), a column ("RO" in in FIG. 7) of the design curvature radius set for the component position, a column ("n0" in FIG. 7) of the initial curvature radius set for the component position, a column of the intermediate curvature radius set for the component position when the component position reaches each of the relative positions n1 to n3 ("n1 to n3" in FIG. 7), and a column ("n4" in FIG. 7) of the curvature radius set for the component position when the component position reaches the relative position n4.

In the present embodiment, an intermediate curvature radius is set for each of the columns of the respective relative positions n1 to n3. These intermediate curvature radiuses are each an estimated value that is estimated by the initial curvature radius applied when an arbitrary unit portion reaching these relative positions is the fulcrum roll unit portion, and strain or bending moment that changes until the arbitrary unit is moved to the bending roll unit portion from the fulcrum roll unit portion.

Curvature radii set to the relative position n4 are the same values as the respective design curvature radii (refer to numerical values in the column of RO and the column of n4). The relative position n4 corresponds to an arbitrary unit portion that is a bending roll unit portion. Thus, when an arbitrary unit portion is a bending roll unit portion (when it reaches the relative position n4), a design curvature radius of a value corresponding to a component position of the arbitrary unit portion is applied.

Here, the relative position n4 is the bending roll contact position 12*a* as well as the end position Rt of the roll interval. This enables the curvature radius set for the component position reached the relative position n4 to be referred to as an "end position curvature radius". The end position curvature radius is the same value as the design curvature radius as described above. In addition, the relative position n0 is the fulcrum roll contact position 11*a* as well as the start position Rs of the roll interval. Thus, the curvature radius set for the component position reached the relative position n0 is the initial curvature radius as described above, and can be referred to as a "start position curvature radius". In other words, it can be expressed that the same value as the initial curvature radius is set as the "start position curvature radius".

For convenience of making it easier to understand that the intermediate curvature radius is set to continuously change from the initial curvature radius to the design curvature radius, Table T0 shows the intermediate curvature radius such that it continuously changes by an equal amount of 10 mm. In practice, however, the curvature radius in the section from the relative position n1 to the relative position n4 also changes exponentially such that strain changes exponentially. Accordingly, the intermediate curvature radius to be set may also be set as a value that exponentially changes.

The unit portion at a component position of 1010 mm will be described, for example, as an example of the design curvature radius, the initial curvature radius, the intermediate curvature radius, and the ending position curvature radius, at an arbitrary unit portion. As shown in Table T0, the design curvature radius is set to 2000 mm in the unit portion of the component position of 1010 mm. When this unit portion reaches the fulcrum roll contact position 11*a* (when it is moved to the fulcrum roll unit portion or reaches the relative position n0), the initial curvature radius to be applied to the elongated extrusion material 21 by the fulcrum roll 11 is set to 1960 mm.

After that, when this unit portion advances from the fulcrum roll contact position 11*a* to the downstream relative position n1 (when it moves to a first intermediate unit portion), its intermediate curvature radius is set to 1970 mm. When this unit portion further advances to the relative position n2 on the downstream side (when it moves to a second intermediate unit portion), its intermediate curvature radius is set to 1980 mm. When this unit portion further advances to the relative position n3 on the downstream side (when it moves to a third intermediate unit portion), its intermediate curvature radius is set to 1990 mm.

When this unit portion further advances to the relative position n4 on the downstream side, its end position curvature radius is set to 2000 mm that is the same value as the design curvature radius. The relative position n4 is the final position of the inter-roll path (the end position Rt of the roll interval) as well as the bending roll contact position 12*a*. Thus, the unit portion at the component position of 1010 mm has moved to the bending roll unit portion, and a design curvature radius corresponding to the component position is applied.

The number of intermediate unit portions in the inter-roll path is not particularly limited. In the example illustrated in FIG. 7, the roll interval is equally divided into four sections, and the five relative positions n0 to n4 are set. This causes the unit portions positioned at the respective relative positions n1 to n3 to be intermediate unit portions, so that three intermediate unit portions are set in FIG. 7. As described above, the number of relative positions (or relative sections) acquired by dividing the roll interval is not particularly limited, so that the number of intermediate unit portions is a number corresponding to the number of divisions of these relative positions. Thus, the number of intermediate unit portions may be one or more.

It is assumed that the same value as the design curvature radius (e.g., a curvature radius of 2000 mm at a component position of 1010 mm) is applied to the elongated extrusion material 21 at the fulcrum roll contact position 11*a*, i.e., at the relative position n0. According to the studies of the inventors of the present invention, it becomes clear that when the elongated extrusion material 21 is fed out from the fulcrum roll contact position 11*a*, the maximum strain is applied to the elongated extrusion material 21 at the relative position n0, and that at the time point when it reaches each of the relative positions n1 to n4 on the downstream side, strain at the same component position exponentially decreases and strain remaining when it passes through the relative position n4 forms a final shape as a permanent deformation. This can be said to be the shape after so-called spring back.

More specifically, according to the studies by the inventors of the present invention, it becomes clear that even when a conventional apparatus for manufacturing a roll-formed component causes a relative change in position of the bending roll 12 with respect to the fulcrum roll 11 to be applied by the roll moving unit 32 so as to be simply proportional to the curvature at a predetermined position of a workpiece, to manufacture a roll-formed component 20 having curvature continuously changing, the roll-formed component 20 cannot obtain a desired curvature change and may be bend or have no bending.

In addition, according to the studies of the inventors of the present invention, it becomes clear that (1) when bending is applied by the bending roll 12, a desired continuous change in curvature cannot be obtained unless the relative position of the bending roll 12 with respect to the fulcrum roll 11 is gradually changed as described below, and that (2) when bending is applied by the bending roll 12, spring back occurs in a workpiece, and only changing a position of the bending roll 12 so as to correspond to application of the initial curvature radius, with respect to a unit portion positioned at the relative position n0, in consideration of influence of the spring back, cannot obtain a desired change in curvature.

This is because (1) the maximum bending strain is actually applied to the workpiece at the fulcrum roll contact position 11*a*, and (2) between the fulcrum roll 11 and the bending roll 12, the workpiece has already passed through the fulcrum roll 11 to become a bent state. Thus, only changing the relative position of the bending roll 12 with respect to the fulcrum roll 11 at a value proportional to a continuous change in curvature cannot obtain a desired continuous change in a roll-formed member finally obtained.

Thus, in the present disclosure, an initial curvature radius in consideration of reduction in strain, and spring back (or apparent bending degree due to application of bending moment) is applied at the fulcrum roll contact position 11*a*, i.e., at the relative position n0, instead of the same value as the design curvature radius. For example, when a unit portion at a component position of 1010 mm in the elongated extrusion material 21 is defined as an "attention portion" for convenience, an initial curvature radius of 1960 mm with respect to a design curvature radius of 2000 mm is applied to the attention portion.

After that, when the elongated extrusion material 21 is fed out to cause the attention portion to reach the relative position n1, the curvature radius of the attention portion changes to the intermediate curvature radius having a value of 1970 mm at the relative position n1. Likewise, when the attention portion reaches the relative position n2, the curvature radius of the attention portion changes to the intermediate curvature radius having a value of 1980 mm at the relative position n2, when it reaches the relative position n3, the curvature radius of the attention portion changes to the intermediate curvature radius having a value of 1990 mm at the relative position n3, and when it reaches the relative position n4, i.e., the bending roll contact position 12*a*, the curvature radius of the attention portion changes to the end position curvature radius having a value of 2000 mm at the relative position n4, i.e., a value that is the same as the design curvature radius in the attention portion (unit portion to be a component position of 1010 mm). Thus, the curvature radius at the bending roll contact position 12*a* is the final curvature radius, and in the example illustrated in FIG. 7, the final curvature radius coincides with the design curvature radius.

In the schematic state illustrated in FIG. 7, five unit portions ranging from a component position of 1010 mm to a component position of 1050 mm are positioned in the inter-roll path. In the five unit portions, the design curvature radius changes from 2000 mm to 1800 mm. In other words, a part of the roll-formed component 20 corresponding to the five unit portions corresponds to the curvature-changing portion 20*b*, the curvature-changing portion 20*e*, the first curvature-changing portion 20*h*, or the second curvature-changing portion 20*j* (or a part of these portions), described above. Thus, bending is applied to each unit portion fed out to the fulcrum roll contact position 11*a* so that an initial curvature radius in consideration of strain reduction or spring back is applied to each unit portion.

In the schematic state illustrated in FIG. 7, it is assumed that the unit portion of 1050 mm at the component position in the elongated extrusion material 21 is fed to the fulcrum roll contact position 11*a*, i.e., the relative position n0, the design curvature radius for the unit portion of 1050 mm is 1800 mm, and an initial curvature radius of 1760 mm is applied to the unit portion of 1050 mm. At this time, when the unit portion at the component position of 1040 mm to which bending is applied just before is defined as an attention portion, the attention portion is fed out the relative position n0 to the relative position n1. The attention portion (the unit portion at the component position of 1040 mm) having reached the relative position n1 has a curvature radius having changed from the applied initial curvature radius of 1810 mm to the intermediate curvature radius at the relative position n1, having a value of 1820 mm.

Likewise, a unit portion at a component position of 1030 mm to which the bending is applied prior to the unit portion at the component position of 1040 mm is fed out from the relative position n0 to the relative position n2. When the unit portion at the component position of 1030 mm is defined as an attention portion, the attention portion having reached the relative position n2 has a curvature radius that has changed from the applied initial curvature radius of 1860 mm to the intermediate curvature radius at the relative position n2, having a value of 1880 mm.

Likewise, a unit portion at a component position of 1020 mm to which the bending is applied prior to the unit portion at the component position of 1030 mm is fed out from the relative position n0 to the relative position n3. When the unit portion at the component position of 1020 mm is defined as an attention portion, the attention portion having reached the relative position n3 has a curvature radius that has changed from the applied initial curvature radius of 1910 mm to the intermediate curvature radius at the relative position n3, having a value of 1940 mm.

Likewise, a unit portion at a component position of 1010 mm to which the bending is applied prior to the unit portion at the component position of 1020 mm is fed out from the relative position n0 to the relative position n4, i.e., the bending roll contact position 12*a*. When the unit portion at the component position of 1010 mm is defined as an attention portion, the attention portion having reached the bending roll contact position 12*a* has a curvature radius that has changed from the applied initial curvature radius of 1960 mm to the end position curvature at the radius relative position n4, having a value of 2000 mm, i.e., the same value as the design curvature radius. Thus, as illustrated by the dotted line in FIG. 7, Table T0 shows that the curvature radius of each unit portion at the same time is a numeric value along the diagonally upper right direction.

As described above, to achieve a predetermined design curvature radius at a predetermined component position, an initial curvature radius in consideration of reduction in strain or spring back (or apparent bending degree) at the fulcrum roll contact position 11*a* is applied at the component position. In addition, as described above, the unit interval of the elongated extrusion material 21 and the lower interval of the roll interval are set to the same length (distance). Thus, it is necessary that the control unit 30 causes the roll moving unit 32 to move the bending roll 12 (move at least one of the fulcrum roll 11 and the bending roll 12) such that when an arbitrary component position at the same time is positioned at the relative position n0 to enable the initial curvature radius to be applied at the fulcrum roll contact position 11*a*, component positions positioned (a reference end 21*p* side) ahead the component position are positioned at the respective relative positions n1 to n4, i.e., a numeric value along the diagonally upper right direction in Table T0 is achieved.

As illustrated in FIG. 5A (and FIG. 7), a predetermined initial curvature radius is applied to a unit portion of the elongated extrusion material 21 (workpiece), having reached the relative position n0, and to a unit portion having reached each of the relative positions n1 to n4, it is necessary to apply a predetermined bending (a value of the intermediate curvature radius or the end position curvature radius at each of the relative positions). Then, the control unit 30 calculates the amount of change in position of the bending roll 12 by integrating the bending position of each of unit portions having reached the respective relative positions n0 to n4, and controls the roll moving unit 32 on the basis of the integrated quantity, i.e., the amount of roll movement.

The amount of change in position of the bending roll 12 in the roll interval can be calculated on the basis of a specific value of an individual initial curvature radius set for a unit portion for each unit interval of the elongated extrusion material 21. For example, based on a bending state of the elongated extrusion material 21 illustrated in FIG. 7, FIG. 8 represents a schematic state of the elongated extrusion material 21, the fulcrum roll 11, and the bending roll 12. The state illustrated in each of FIGS. 7 and 8 corresponds to a state at the time when arbitrary unit intervals D1 to D5 of the elongated extrusion material 21 (roll-formed component 20) coincide with the relative positions n0 to n4 of the inter-roll path, respectively.

FIG. 8 schematically illustrates not only the elongated extrusion material 21 with a thick line, but also each of the fulcrum roll 11 and the bending roll 12 with a block arrow, and sets a two-dimensional plane PL (indicated by a dotted line) in XY-direction, including a bending direction of the elongated extrusion material 21. In FIG. 8, unit portions corresponding to the unit interval D1 to D4 are designated by reference signs 21-1 to 21-4, respectively, for convenience of description. The unit portions 21-1 to 21-4 of the elongated extrusion material 21 each have a component position coinciding with the corresponding one of the relative positions n1 to n4.

The unit interval D1 of the elongated extrusion material 21 corresponds to the interval between the relative position n0 and the relative position n1. As described above, a predetermined initial curvature radius shown in Table T0 is applied to the unit portion 21-1 corresponding to the unit interval D1. At this time, as illustrated in FIG. 8, a distance from a start point A0 of the unit interval D1 corresponding to the relative position n0 to an end point A1 of the unit interval D1 corresponding to the relative position n1 can be calculated as a distance X1 in X-direction and a distance Y1 in Y-direction.

In the unit interval D2 downstream of the unit interval D1, a value of an initial curvature radius corresponding to the relative position n2 is applied to an end point A2 corresponding to the relative position n2, i.e., the unit portion 21-2 corresponding to the unit interval D2. A start point A1 of the unit interval D2 is the end point of the unit interval D1, and corresponds to the relative position n1 as described above. At this time, a distance between the start point A1 of the unit interval D2 and the end point A2 of the unit interval D2 can be calculated as a distance X2 in X-direction and a distance Y2 in Y-direction.

Likewise, a value of an initial curvature radius corresponding to the relative position n3 is applied to an end point A3, i.e., the unit portion 21-3, also in the unit interval D3. Thus, a distance from the start point A2 to the end point A3 of the unit interval D3 can be calculated as a distance (X3) in X-direction and a distance (Y3) in Y-direction. Likewise, a value of an initial curvature radius (the same value as the design curvature radius) corresponding to the relative position n4 is applied to an end point A4, i.e., the unit portion 21-4, also in the unit interval D4. Thus, a distance from the start point A3 to the end point A4 of the unit interval D4 can be calculated as a distance (X4) in X-direction and a distance (Y4) in Y-direction.

With reference to the curvature-radius database 31, the control unit 30 integrates distances X1 to Xn, and Y1 to Yn of the corresponding unit intervals D1 to Dn of an elongated extrusion material 21, positioned from the fulcrum roll contact position 11*a* to the bending roll contact position 12*a* (roll interval), when the elongated extrusion material 21 (workpiece) is fed out from the fulcrum roll 11, thereby acquiring the amount of roll movement. While the amount of roll movement (integrated value) may be calculated every time from a shape of the roll-formed component 20, a pre-calculated value may be stored in the curvature-radius database 31, or a pre-calculated value converted into an NC program may be registered in the control unit 30 or the like.

In the example illustrated in each of FIGS. 7 and 8, the five relative positions n0 to n4 are set in the roll interval, and four equal intervals (lower intervals) are set between the corresponding adjacent positions, as described above. A distance between the corresponding adjacent relative positions n0 to n4 is the same as a distance of the unit interval D, so that there are four unit intervals D1 to D4 in the roll interval. Thus, the control unit 30 may integrate the distances of the four unit intervals D1 to D4 at the time when a start point of an arbitrary unit portion reaches the relative position n0 (X1+X2+X3+X4, and Y1+Y2+Y3+Y4). The control unit 30 causes the roll moving unit 32 to change a relative position of the bending roll 12 with respect to the fulcrum roll 11 on the basis of the integrated quantity (amount of roll movement). When the roll interval is divided into "n" relative positions (or relative sections), there are "n" unit intervals D1 to Dn in the roll interval. Thus, distances of "n" unit intervals D may be integrated.

In other words, the control unit 30 sets a two-dimensional plane PL including a bending direction of a workpiece (refer to FIG. 8), and may integrate the amount of change in position using two-dimensional coordinates in the two-dimensional plane PL. Setting the two-dimensional plane PL including the bending direction enables obtaining a two-dimensional coordinate (a distance from a start point to an end point) based on an initial curvature radius at each relative position, as described above. Then, integrating absolute values of distances based on numerical values of the two-dimensional coordinates enables obtaining a two-dimensional coordinate corresponding to a position of the bending roll 12. The control unit 30 may cause the roll moving unit 32 so as to position the bending roll 12 at the obtained two-dimensional coordinate.

It is needless to say that specific control of the roll moving unit 32 by the control unit 30 is not limited to integration of distances, or control using two-dimensional coordinates, as described above. The control unit 30 can control the roll moving unit 32 using various other control methods.

[Relationship Between Change in Curvature Radius and Change in Relative Position of Bending Roll]

Next, a relationship between change in a curvature radius of the roll-formed component 20 and change in relative position of the bending roll 12 will be specifically described with reference to FIGS. 9A and 9B. In the present embodiment, the bending roll 12 is moved in a stroke direction intersecting (orthogonal) to the bending path, so that a relative position of the bending roll 12 is referred to as a "stroke position".

Figure 9A:
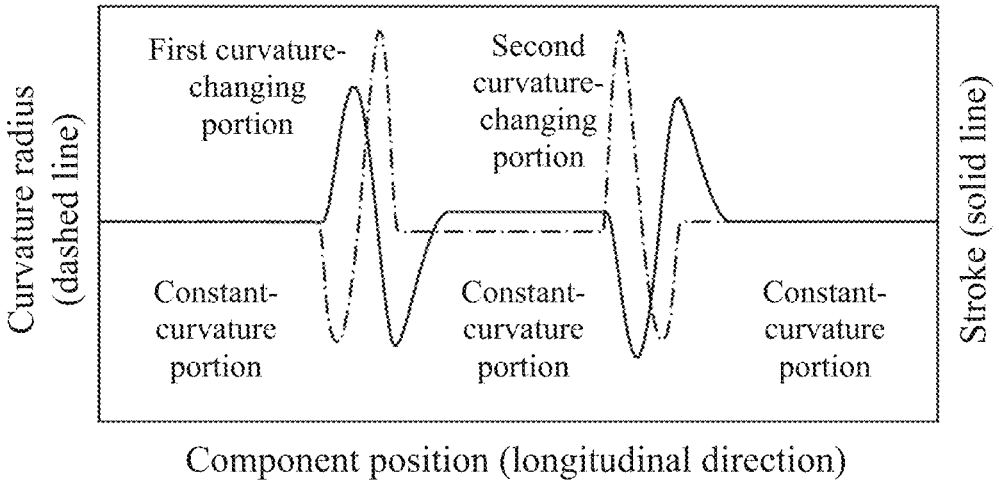
FIG. 9A is a graph illustrating a relationship between change in a curvature radius of a roll-formed component and change in a stroke of the bending roll in the apparatus for manufacturing a roll-formed component illustrated in FIG. 5A.
Figure 9B:
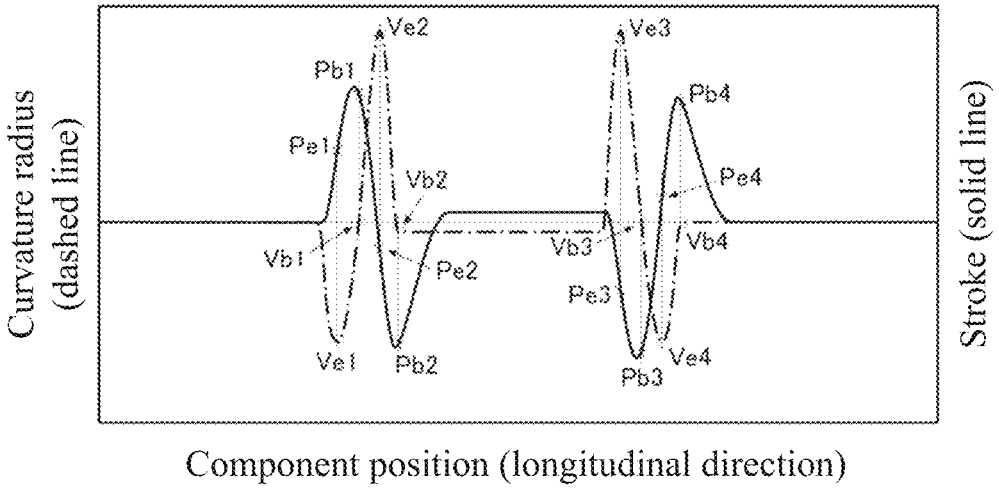
FIG. 9B is a graph for illustrating a deviation between the change in a curvature radius and the change in a stroke in the graph illustrated in FIG. 9A.

The graphs illustrated in FIGS. 9A and 9B show the same change, and the horizontal axis represents a component position of the roll-formed component 20, the first vertical axis represents a curvature radius of the roll-formed component 20 to a component position, and the second vertical axis represents a stroke position of the bending roll 12. Each of the graphs corresponds to manufacture of the roll-formed component 20C illustrated in FIG. 3.

Each of FIGS. 9A and 9B shows a stroke position of the bending roll 12 in the second vertical axis, at which an arbitrary component position of a workpiece (elongated extrusion material 21), which is to be a roll-formed component 20, is positioned at the fulcrum roll contact position 11*a*. This is for convenience of describing the maximum bending that is applied to the workpiece when an arbitrary component position of the workpiece passes through the fulcrum roll 11.

The stroke position on the second vertical axis is referred to as a stroke position with respect to the fulcrum roll contact position 11*a*, for convenience. Then, when a stroke position in the second vertical axis in each of FIGS. 9A and 9B is indicated with respect to the bending roll contact position 12*a*, a graph indicating stroke positions is illustrated while being moved to the right from the positions illustrated in each of FIGS. 9A and 9B. When a stroke position of the bending roll 12 in the second vertical axis is defined as a stroke position at which an arbitrary component position of a workpiece is at the bending roll contact position 12*a*, the reference position is changed from the fulcrum roll contact position 11*a* to the bending roll contact position 12*a*. Accordingly, the graph indicating the stroke positions in each of FIGS. 9A and 9B is illustrated while being moved to the right by a distance between the bending roll 12 and the fulcrum roll 11 (i.e., the roll interval).

Each of FIGS. 9A and 9B illustrates the graph of curvature radii indicated by a dashed line, and the graph of stroke positions indicated by a solid line. In FIG. 9B, reference signs indicating respective change points, which are not designated in FIG. 9A, are designated for convenience of describing a difference between the graph of curvature radii against respective component positions and the graph of stroke positions against respective component positions.

As the roll-formed component 20 is fed out to be changed in position in its longitudinal direction (component position), change in a final curvature radius of the roll-formed component 20 and change in a stroke position of the bending roll 12 (a relative position of the bending roll 12 to the fulcrum roll 11) show a complicated difference as illustrated in FIGS. 9A and 9B.

As described above, the roll-formed component 20 has not only the constant-curvature portions 20*g*, 20*i*, and 20*k* in each of which a constant curvature radius is maintained along its longitudinal direction, but also the first curvature-changing portion 20*h* and the second curvature-changing portion 20*j* in each of which a curvature radius changes so as to continuously increase or decrease (refer to FIG. 3). As illustrated in FIG. 9A, the control unit 30 may cause the roll moving unit 32 to maintain uniformly a stroke position of the bending roll 12 because a workpiece has portions corresponding to the constant-curvature portions 20*g*, 20*i*, and 20*k*, the portions each having a constant curvature radius. As illustrated in FIG. 9A, the curvature radius and the stroke position are not changed and are constant at the component positions corresponding to the respective constant-curvature portions 20*g*, 20*i*, and 20*k*.

For convenience, a constant curvature radius at each of the constant-curvature portions 20*g*, 20*i*, and 20*k* is defined as a "reference curvature radius", and a constant stroke position of the bending roll 12 corresponding to the reference curvature radius is defined as a "reference position". FIGS. 9A and 9B each illustrate curvature radii and reference positions while superimposing them to make it easy to understand a difference between a behavior of change in a curvature radius against a component position (a graph by a dashed line) and a behavior of change in a stroke position of the bending roll 12 (a graph by a solid line).

As illustrated in FIG. 3, a curvature radius changes against a component position in the first curvature-changing portion 20*h* as follows: it continuously decreases to reach the minimum value; it then increases so as to return to the reference curvature radius; it then continuously increases to reach the maximum value; and it then decreases so as to return to the reference curvature radius.

As illustrated in FIG. 9B, when the minimum value of the curvature radius in the first curvature-changing portion 20*h* is indicated as Ve1, the maximum value of the curvature radius therein is indicated as Ve2, and the reference curvature radius therein is indicated as Vb1 or Vb2, a curvature radius changes in the first curvature-changing portion 20*h* as follows: it continuously decreases until it reaches the minimum value Ve1; it then continuously increases to reach the reference curvature radius Vb1; it then further continuously increases to reach the maximum value Ve2; and it then continuously decreases to return to the reference curvature radius Vb2.

As illustrated in FIG. 3, a curvature radius changes against a component position in the second curvature-changing portion 20*j* as follows: it continuously increases to reach the maximum value; it then decreases so as to return to the reference curvature radius; it then further continuously decreases to reach the minimum value; and it then increases so as to return to the reference curvature radius, contrary to the first curvature-changing portion 20*h*.

As illustrated in FIG. 9B, when the maximum value of the curvature radius in the second curvature-changing portion 20*j* is indicated as Ve3, the minimum value of the curvature radius therein is indicated as Ve4, and the reference curvature radius therein is indicated as Vb3 or Vb4, a curvature radius changes in the second curvature-changing portion 20*j* as follows: it continuously increases until it reaches the maximum value Ve3; it then continuously decreases to reach the reference curvature radius Vb3; it then further continuously decreases to reach the minimum value Ve4; and it then continuously increases to return to the reference curvature radius Vb4.

In contrast, a stroke position of the bending roll 12 changes against a component position in the first curvature-changing portion 20*h* as follows: it continuously increases to reach the maximum value; it then decreases so as to return to the reference position; it further continuously decreases to reach the minimum value; and it then increases so as to return the reference position. As illustrated in FIGS. 9A and 9B, the component position at which the change in a curvature radius starts is naturally substantially the same as the component position at which the change of a stroke position of the bending roll 12 starts. However, the change in a stroke position against a component position does not completely opposite in direction to the change in a curvature radius, and there is a unique difference between the changes as illustrated in FIGS. 9A and 9B.

As illustrated in FIG. 9B, the maximum value of a stroke position in the first curvature-changing portion 20*h* is indicated as Pb1, and the minimum value of a stroke position is indicated as Pb2. In addition, a stroke position at a component position when a curvature radius reaches the minimum value Ve1 is indicated as Pe1, and a stroke position at a component position when a curvature radius reaches the maximum value Ve2 is indicated as Pe2.

The change in a stroke position in the first curvature-changing portion 20*h* is as follows: the stroke position Pe1 at the time when a component position reaches a portion in which a curvature radius becomes the minimum value Ve1 corresponds to a value within a range of 45% to 55% of an absolute value of the maximum value Pb1 of the stroke position; and the stroke position Pe2 at the time when a curvature radius of the first curvature-changing portion 20*h* returns to the reference curvature radius Vb1 corresponds to a value of 90% or more and less than 100% of an absolute value of the minimum value Pb2 of a stroke position.

A stroke position of the bending roll 12 changes against a component position in the second curvature-changing portion 20*j* as follows: it continuously decreases to reach the minimum value; it then increases so as to return to the reference position; it then continuously increases to reach the maximum value; and it then increases so as to return to the reference position.

As illustrated in FIG. 9B, the minimum value of a stroke position in the second curvature-changing portion 20*j* is indicated as Pb3, and the maximum value of a stroke position is indicated as Pb4. In addition, a stroke position at a component position when a curvature radius reaches the maximum value Ve3 is indicated as Pe3, and a stroke position at a component position when a curvature radius reaches the minimum value Ve4 is indicated as Pe4.

The change in a stroke position in the second curvature-changing portion 20*j* is as follows: the stroke position Pe3 at the time when a component position reaches a portion in which a curvature radius becomes the maximum value Ve3 corresponds to a value within a range of 45% to 55% of an absolute value of the minimum value Pb3 of the stroke position; and the stroke position Pe3 at the time when a curvature radius of the second curvature-changing portion 20*j* returns to the reference curvature radius Vb3 corresponds to a value of 90% or more and less than 100% of an absolute value of the maximum value Pb4 of a stroke position.

In each of the first curvature-changing portion 20*h* and the second curvature-changing portion 20*j*, the bending roll 12 is still changing in a stroke position (90% to 100% at the peak time (extreme value)) at a component position at which a curvature radius finally returns to the reference curvature radius (Vb2 or Vb4), and the stroke position changes to return to the reference position quite a while later in position (quite a while later in time as views as time of bending) after the curvature radius returns to the reference curvature radius.

Change in a stroke position against change in a curvature radius as described above can be summarized as follows.

In roll forming (bending), bending for determining a shape is applied at the fulcrum roll contact position 11*a* by the fulcrum roll 11. That is, when a portion of a workpiece (elongated extrusion material 21), corresponding to a portion different in curvature in the roll-formed component 20, passes through the fulcrum roll contact position 11*a*, strain (or bending moment in other words) suitable for the curvature needs to be applied.

However, the strain applied at the fulcrum roll contact position 11*a* is not applied only by the fulcrum roll 11, but is applied by relative movement of the fulcrum roll 11 and the bending roll 12. Thus, when the manufacturing apparatus 10A is configured such that roll forming and roll bending continue to each other, moving (operating) the bending roll 12 positioned downstream enables strain (or bending moment) to be introduced to a portion reaching the fulcrum roll contact position 11*a*.

Alternatively, it can be said that a shape of the portion reaching the fulcrum roll contact position 11*a* is determined by a movement position of the bending roll 12. However, between the fulcrum roll contact position 11*a* and the bending roll contact position 12*a*, there is a portion (referred to as a "bent portion" for convenience) bent before reaching there between. Thus, the movement position of the bending roll 12 needs to be in a position in consideration of the bent portion described above (set by reflecting bending of the bent portion).

In particular, as the workpiece advances from the fulcrum roll contact position 11*a* to the bending roll contact position 12*a*, strain or bending moment acting on an arbitrary portion of the bent workpiece gradually decreases. Thus, in a portion of the workpiece positioned between the fulcrum roll contact position 11*a* and the bending roll contact position 12*a*, a degree of influence of bending by the bending roll 12 increases toward the fulcrum roll contact position 11*a*. As a result, the change in a stroke position of the bending roll 12 behaves somewhat "behind" the change in a curvature radius.

[Modification]

Figure 10:
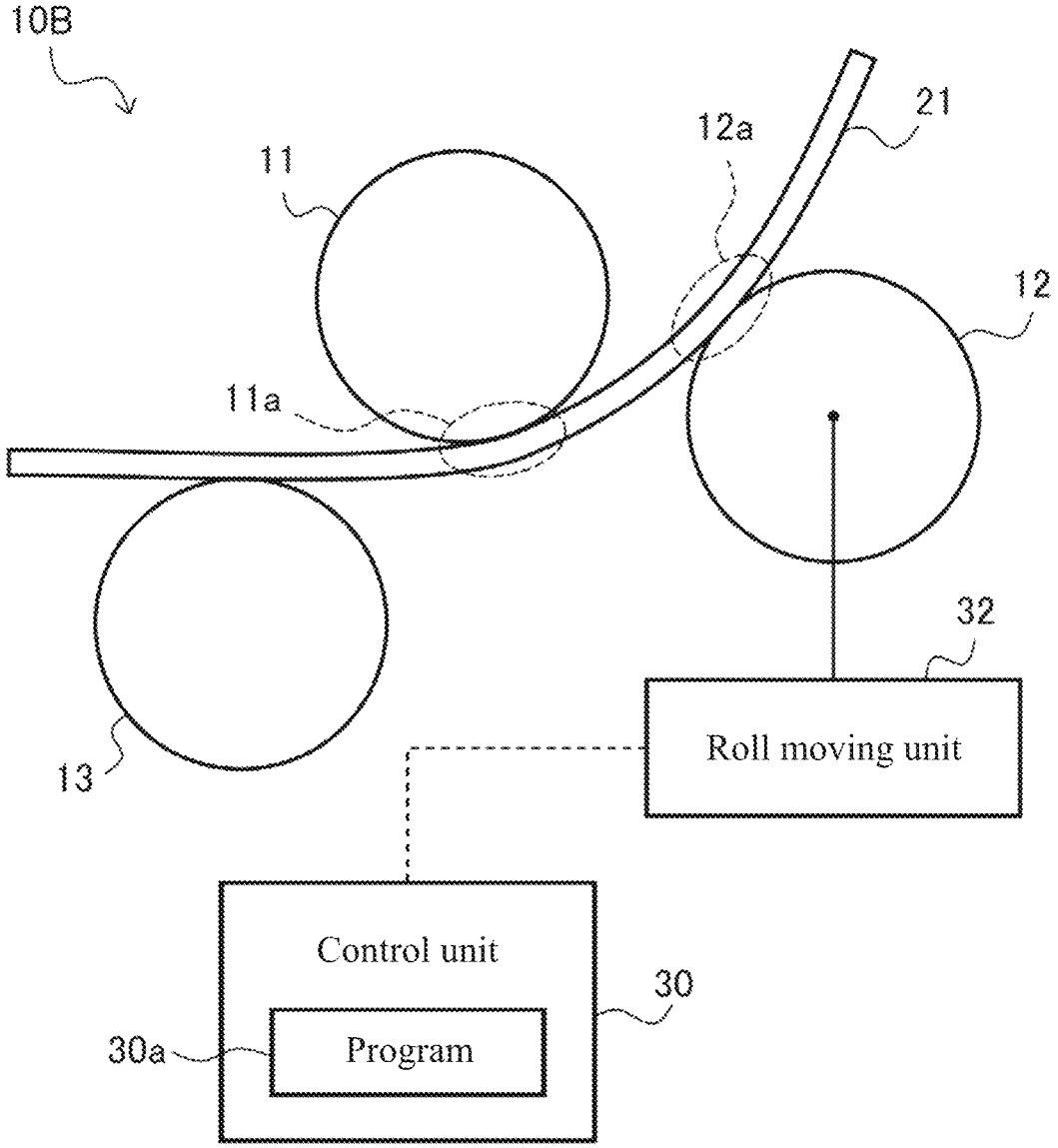
FIG. 10 is a schematic view illustrating another example of the apparatus for manufacturing a roll-formed component according to the embodiment of the present disclosure.

While the manufacturing apparatus 10A described above is configured such that the control unit 30 refers to the curvature-radius database 31 as illustrated in FIG. 5A, the present disclosure is not limited to this. For example, a manufacturing apparatus 10B illustrated in FIG. 10 is configured without the curvature-radius database 31. That is, the present disclosure allows the curvature-radius database 31 provided in the manufacturing apparatus 10A not to be an indispensable configuration, and may allow a manufacturing apparatus to be configured as with the manufacturing apparatus 10B that includes the control unit 30 and the roll moving unit 32 without including the curvature-radius database 31.

As described above, the control unit 30 may convert an integrated value of distances for each unit interval in a roll interval into an NC program to register the NC program in the control unit 30 or the like. Thus, as illustrated in FIG. 10, the control unit 30 may be configured to store a program 30*a* in a storage unit or the like (not shown) to control the roll moving unit 32 according to the program 30*a*. This configuration does not require an integrated value to be calculated with reference to the curvature-radius database 31. Thus, in the present disclosure, the curvature-radius database 31 may not be an indispensable configuration.

Figure 11:
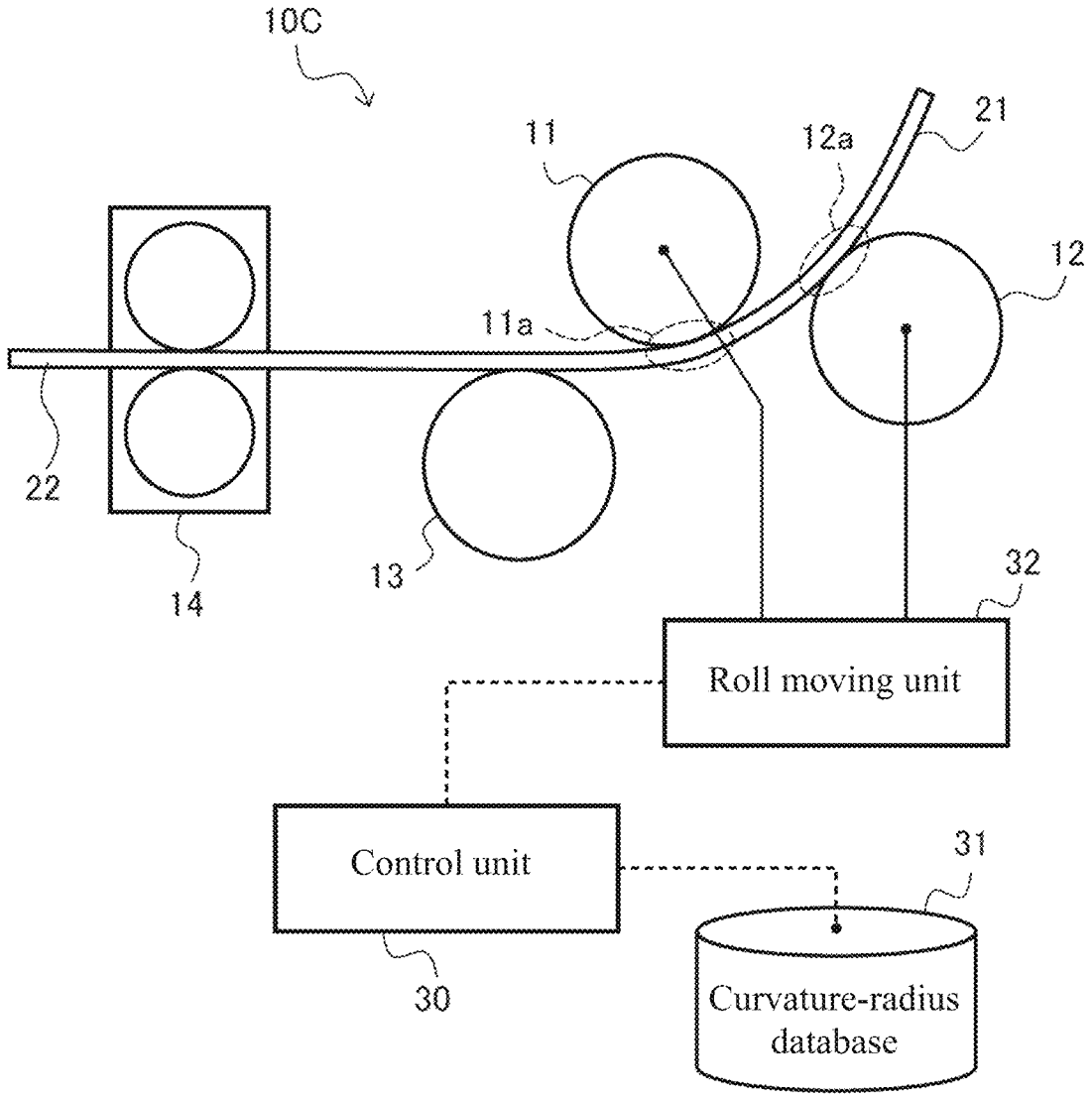
FIG. 11 is a schematic view illustrating yet another example of the apparatus for manufacturing a roll-formed component according to the embodiment of the present disclosure.

While the manufacturing apparatus 10A described above is configured such that the roll moving unit 32 moves only the bending roll 12 as illustrated in FIG. 5A, the present disclosure is not limited to this. FIG. 11 illustrates a manufacturing apparatus 10C in which the roll moving unit 32 is configured to be capable of moving both the fulcrum roll 11 and the bending roll 12 as described above. While not shown here, the roll moving unit 32 may be configured to move only the fulcrum roll 11, and the bending roll 12 may be fixed. The other configurations of the manufacturing apparatus 10C are the same as those of the manufacturing apparatus 10A, so that description thereof is eliminated.

While, in the manufacturing apparatus 10A described above, a workpiece just before being subjected to bending by the bending roll 12 has a cross-section including a folded portion or a bent portion in its cross-sectional direction, the workpiece being an elongated extrusion material 21, the workpiece is not limited to this. It may be a plate-shaped elongated sheet material having no predetermined cross-section.

In addition, while, in the manufacturing apparatus 10A described above, the control unit 30 integrates the amount of change in position of the bending roll 12 for each unit interval in a roll interval on the basis of the fact that strain at the same component position exponentially decreases (spring back occurs in an exponential manner like the strain), and controls the roll moving unit 32 on the basis of the integrated quantity, the present disclosure is not limited to this. For example, the amount of change in position for each unit interval may be integrated by approximately substituting a linear (proportional) decrease of strain (or occurrence of spring back) for an exponential decrease of strain (or exponential occurrence of spring back).

Further, while, in the manufacturing apparatus 10A described above, the control unit 30 applies an initial curvature radius at the fulcrum roll contact position 11*a* so that the design curvature radius is substantially the same as the final curvature radius, the present disclosure is not limited to this. As described above, the final curvature radius may be approximate to the design curvature radius within a range of accuracy of a curvature radius required in the roll-formed component 20, or the final curvature radius may be set to a value different from the design curvature radius in consideration of post-forming to be applied to the roll-formed component 20, or the like.

For example, when an aluminum alloy for an aircraft is forming, artificial aging is performed after forming. Here, it is known that applying artificial aging to a member of an aluminum alloy molded changes a lattice coefficient of the aluminum alloy to cause a molded product to be slightly changed in shape. In such a case, the final curvature radius may be set to a value different from the design curvature radius by the amount of change.

While, in the manufacturing apparatus 10A described above, a single initial curvature radius is set for a design curvature radius for each unit interval (component position) and stored in the curvature-radius database 31, the present disclosure is not limited to this. As the initial curvature radius, a plurality of different values may be set on the basis of at least physical properties of a workpiece. For example, physical properties such as strength of a workpiece may be changed depending on heat treatment applied to the workpiece or other conditions. Thus, the curvature-radius database 31 may store an initial curvature radius that is set for a design curvature radius for each unit interval in accordance with strength of a workpiece to deal with a difference in physical properties of the workpiece as described above. The control unit 30 may appropriately cause the roll moving unit 32 to change a relative position of the bending roll 12, according to different values of the initial curvature radius.

Figure 12:
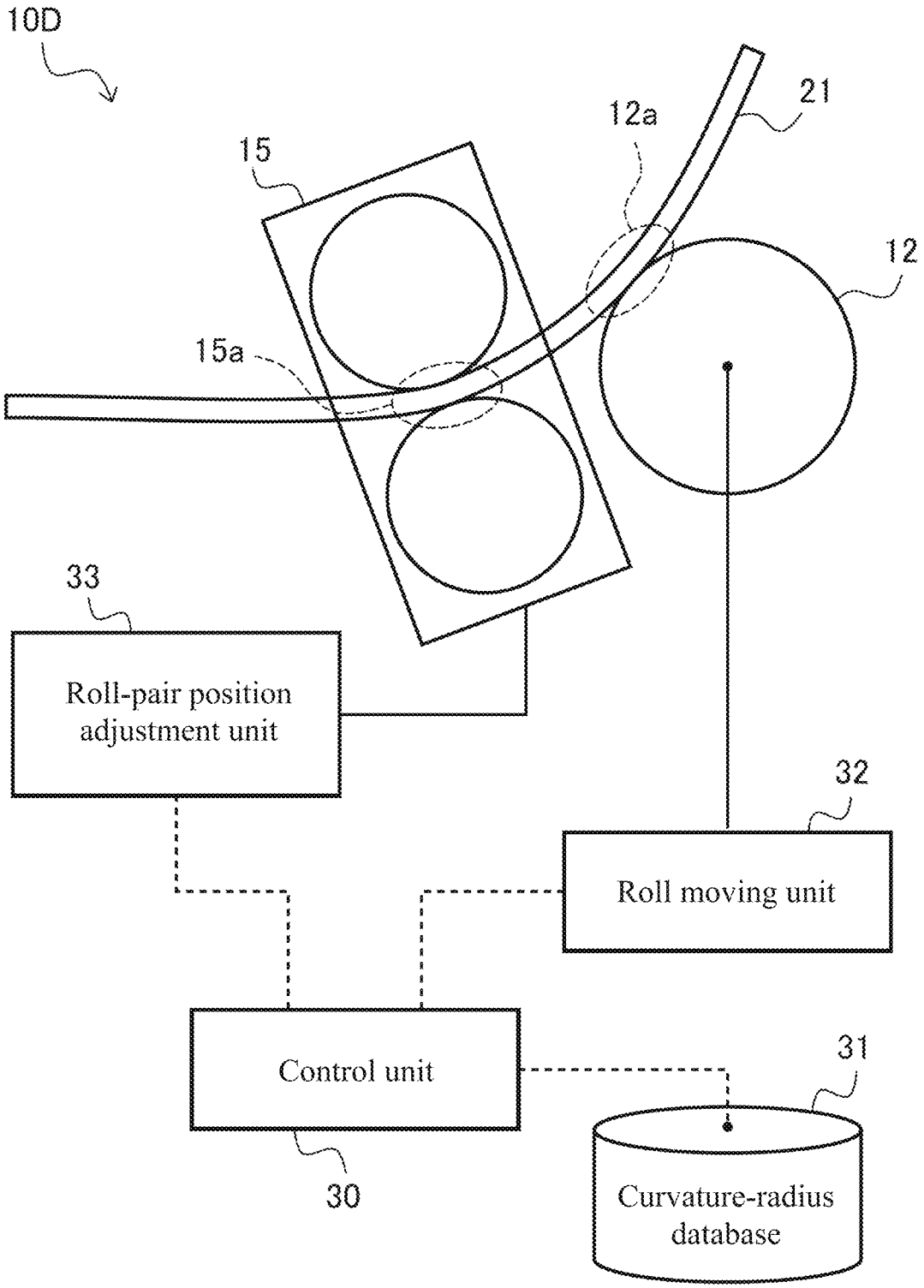
FIG. 12 is a schematic view illustrating yet another example of the apparatus for manufacturing a roll-formed component according to the embodiment of the present disclosure.

In addition, while a single roll is exemplified as each of the fulcrum roll 11 and the bending roll 12, provided in each of the manufacturing apparatus 10A, the manufacturing apparatus 10B, and the manufacturing apparatus 10C, described above, the present disclosure is not limited to this. For example, at least one of the fulcrum roll 11 and the bending roll 12 may be configured as a pair of rolls across the elongated extrusion material 21 (workpiece) as in a manufacturing apparatus 10D illustrated in FIG. 12. In the manufacturing apparatus 10D illustrated in FIG. 12, a pair of fulcrum rolls 15 is substituted for the fulcrum roll 11 in the manufacturing apparatus 10A or 10B. FIG. 12 illustrates a position at which the pair of fulcrum rolls 15 is brought into contact with an elongated extrusion material 21 (workpiece) as a fulcrum roll contact position 15*a*. Instead of the fulcrum roll 11, a pair of rolls may be substituted for the bending roll 12, or a pair of rolls may be substituted for each of the fulcrum roll 11 and the bending roll 12.

When at least one of the fulcrum roll 11 and the bending roll 12 is a pair of rolls, the manufacturing apparatus 10D may further include a roll-pair position adjustment unit 33 that adjusts a position of the pair of rolls such that the pair of rolls is perpendicular to a surface of an elongated extrusion material 21 (workpiece) as illustrated in FIG. 12. A specific configuration of the roll-pair position adjustment unit 33 is not particularly limited, and a well-known perpendicular-to-surface mechanism or the like in the field of a roll bending apparatus or the like can be suitably used. While the roll-pair position adjustment unit 33 is provided as a separate mechanism from the roll moving unit 32 in FIG. 12, the roll-pair position adjustment unit 33 and the roll moving unit 32 may be integrated as a single mechanism.

In the present disclosure, a forming roll unit 14 may be provided upstream of the feeding roll 13 in the bending path, as in the manufacturing apparatus 10C illustrated in FIG. 11. Examples of the forming roll unit 14 may include a roll device for imparting a predetermined cross-section to a flat elongated sheet 22. The forming roll unit 14 may be configured so as to be capable of imparting not only a predetermined cross-section but also a portion where at least one of width and thickness continuously changes along its longitudinal direction. While FIG. 11 schematically illustrates the forming roll unit 14 as a single pair of rolls, the present disclosure is not limited to this configuration as a matter of course.

In other words, the roll-formed component 20 manufactured according to the present disclosure may include not only a portion where a curvature radius continuously changes but also a portion where at least one of width and thickness continuously changes along its longitudinal direction. While the first curvature-changing portion 20*h* and the second curvature-changing portion 20*j* are each a part of the roll-formed component 20 in the roll-formed component 20C illustrated in FIG. 3, the roll-formed component 20 may be continuously changed in a curvature radius throughout its longitudinal direction.

In addition, the roll-formed component 20 may include a portion where a curvature radius changes stepwise rather than continuously. In this case, the manufacturing apparatus 10A or 10B may be configured such that the control unit 30 causes the roll moving unit 32 to change a relative position (stroke position) of the bending roll 12 so as to impart a change in the curvature radius stepwise.

As described above, according to the present disclosure, a design curvature radius is preset for a position of the roll-formed component 20 manufactured in its longitudinal direction, and the initial curvature radius being a curvature radius before spring back occurs or strain is reduced is preset for the design curvature radius to form a database. The control unit 30 integrates the amount of change in position of the bending roll 12 based on an individual design curvature radius in each unit interval in a period from the fulcrum roll contact position 11*a* to the bending roll contact position 12*a* when a workpiece is fed out from the fulcrum roll 11, with reference to the database. The control unit 30 controls the roll moving unit 32 such that a relative positional change of the bending roll 12 with respect to the fulcrum roll 11 becomes the amount of change in position based on this integrated quantity.

In this configuration, not only the initial curvature radius is set by paying attention to the fulcrum roll contact position

11*a*, but also a position of the bending roll 12 with respect to the fulcrum roll 11 is determined such that a workpiece advanced from the fulcrum roll contact position 11*a* toward the bending roll contact position 12*a* has a shape formed by accumulating a bending shape. This enables a relative position of the bending roll 12 to the fulcrum roll 11 to be gradually changed to provide a continuous curvature change to the workpiece. As a result, a portion with curvature continuously changing can be formed at a desired position in the roll-formed component 20 obtained, in its longitudinal direction. This enables a molded part including a portion in which curvature is freely changed in at least a part in its longitudinal direction to be manufactured by roll forming.

It is needless to say that the present disclosure includes not only an apparatus for manufacturing a roll-formed component, having the above-described configuration, but also a method of manufacturing a roll-formed component.

In addition, the present invention is not limited to the description of the embodiment described above, and various modifications are possible within a range shown in the scope of claims, and an embodiment that can be acquired by appropriately combining technical means disclosed in each of different embodiments and a plurality of modifications is also included in the technical scope of the present invention.

As described above, an apparatus for manufacturing a roll-formed component, according to the present invention, manufactures a roll-formed component with curvature changing continuously along its longitudinal direction by applying roll bending to an elongated sheet or an elongated extrusion material, being a workpiece, along its longitudinal direction. The apparatus includes a fulcrum roll that is positioned upstream of the workpiece in a bending path to support the workpiece during bending, or to serve as a fulcrum of bending, a bending roll positioned downstream of the fulcrum roll in the bending path to apply bending to the workpiece, a roll moving unit that moves at least one of the fulcrum roll and the bending roll so as to relatively change a position of the bending roll with reference to a position of the fulcrum roll, and a control unit. Under the following conditions: a position allowing the fulcrum roll to be brought into contact with the workpiece is set as a fulcrum roll contact position; a position allowing the bending roll to be brought into contact with the workpiece is set as a bending roll contact position; when the roll-formed component is divided into a plurality of unit intervals in its longitudinal direction, a design value of a curvature radius of an unit portion corresponding to each of the unit intervals in the roll-formed component is set as a design curvature radius; a curvature radius applied to the workpiece at the fulcrum roll contact position is set as an initial curvature radius; and a curvature radius remaining in the workpiece when the workpiece is fed out from the bending roll contact position to achieve the design curvature radius in the roll-formed component is set as a final curvature radius, the initial curvature radius is set as a curvature radius to be applied to the workpiece before spring back occurs by applying bending to the workpiece. Under the following conditions: the unit portion positioned at the fulcrum roll contact position at the time when the workpiece is fed to a nip between the fulcrum roll and the bending roll is set as a fulcrum roll unit portion; the unit portion positioned at the bending roll contact position is set as a bending roll unit portion; and the unit portion positioned between the unit portions above, corresponding to each of the unit intervals, is set as an intermediate unit portion, the control unit integrates the amount of change in bending position in each of the intermediate unit portion and the bending roll unit portion when an intermediate curvature radius set so as to continuously change curvature of the intermediate unit portion from the initial curvature radius to the design curvature radius is applied to the intermediate unit portion, and the design curvature radius is applied to the bending roll unit portion, to apply the initial curvature radius corresponding to the unit portion to the fulcrum roll unit portion and apply the design curvature radius corresponding to the unit portion to the bending roll unit portion. The control unit causes the roll moving unit to be driven to move at least one of the fulcrum roll and the bending roll on the basis of an integrated value.

According to the above configuration, a design curvature radius is preset for a position of the roll-formed component manufactured in its longitudinal direction, and the initial curvature radius being a curvature radius before spring back occurs is preset for the design curvature radius to form a database. The control unit integrates a relative amount of change in position of the bending roll based on an individual design curvature radius in each unit interval in a period from the fulcrum roll contact position to the bending roll contact position when a workpiece is fed out from the fulcrum roll, with reference to the database. The control unit controls the roll moving unit such that a relative positional change of the bending roll with respect to the fulcrum roll becomes an amount of change in position based on this integrated quantity.

In this configuration, not only the initial curvature radius is set by paying attention to the fulcrum roll contact position, but also a position of the bending roll with respect to the fulcrum roll is determined such that a workpiece advanced from the fulcrum roll contact position toward the bending roll contact position has a shape formed by accumulating a bending shape. This enables a relative position of the bending roll to the fulcrum roll to be gradually changed to provide a continuous curvature change to the workpiece. Thus, a portion with curvature continuously changing can be formed at a desired position in the roll-formed component obtained, in its longitudinal direction. As a result, a roll-formed component can be adjusted or controlled to have favorable curvature along its longitudinal direction in manufacturing thereof.

The apparatus for manufacturing a roll-formed component, having the configuration described above, may be configured such that the intermediate curvature radius is set from a value of the initial curvature radius applied when the unit portion is the fulcrum roll unit portion, and strain or bending moment, changing during a period in which the unit portion is the intermediate unit portion.

The apparatus for manufacturing a roll-formed component, having the configuration described above, also may be configured such that the intermediate curvature radius is set based on the fact that strain or bending moment at the unit portion decreases gradually as the unit portion is moved from the fulcrum roll unit portion to the bending roll unit portion.

The apparatus for manufacturing a roll-formed component, having the configuration described above, also may be configured such that at least the design curvature radius and the initial curvature radius in all the unit portions of the roll-formed component are preliminarily prepared as the curvature-radius database and the control unit calculates the integrated quantity with reference to the curvature-radius database.

The apparatus for manufacturing a roll-formed component, having the configuration described above, also may be configured to further include a feeding roll positioned upstream of the fulcrum roll in the bending path to feed the workpiece toward the fulcrum roll.

The apparatus for manufacturing a roll-formed component, having the configuration described above, also may be configured such that the fulcrum roll is fixed in position and only the bending roll is moved by the roll moving unit.

The apparatus for manufacturing a roll-formed component, having the configuration described above, also may be configured such that a plurality of different values are set as the initial curvature radius constituting the curvature-radius database based on at least physical properties of the workpiece, and the control unit controls the roll moving unit according to the different values of the initial curvature radius.

The apparatus for manufacturing a roll-formed component, having the configuration described above, also may be configured such that the workpiece just before being subjected to bend by the bending roll has a cross-section including a folded portion or a bent portion in its cross-sectional direction.

The apparatus for manufacturing a roll-formed component, having the configuration described above, also may be configured such that the roll-formed component includes a portion where at least one of width and thickness continuously changes along its longitudinal direction.

The apparatus for manufacturing a roll-formed component, having the configuration described above, also may be configured to further include a roll unit for continuously changing at least one of width and thickness of the workpiece in its longitudinal direction.

The apparatus for manufacturing a roll-formed component, having the configuration described above, also may be configured such that at least one of the fulcrum roll and the bending roll is configured as a pair of rolls across the workpiece, and configured to further include a roll-pair position adjustment unit that adjusts the pair of rolls such that it is positioned perpendicular to a surface of the workpiece.

The apparatus for manufacturing a roll-formed component, having the configuration described above, also may be configured such that the roll-formed component is a frame component for an aircraft.

In addition, a method of manufacturing a roll-formed component, according to the present disclosure, is configured to manufacture a roll-formed component including a portion with curvature continuously changing along its longitudinal direction by applying roll bending to an elongated sheet or an elongated extrusion material, being a workpiece, along its longitudinal direction. The method may include the steps of: supporting the workpiece during bending by a fulcrum roll provided upstream of the workpiece in a bending path, or allowing the fulcrum roll to serve as a fulcrum of bending; applying bending to the workpiece by a bending roll positioned downstream of the fulcrum roll in the bending path; moving at least one of the fulcrum roll and the bending roll so as to relatively change a position of the bending roll with reference to a position of the fulcrum roll by using a roll moving unit; setting a position allowing the fulcrum roll to be brought into contact with the workpiece as a fulcrum roll contact position; setting a position allowing the bending roll to be brought into contact with the workpiece as a bending roll contact position; setting a design value of a curvature radius of each of the unit intervals in the roll-formed component as a design curvature radius when the roll-formed component is divided into a plurality of unit intervals in its longitudinal direction; setting a curvature radius applied to the workpiece at the fulcrum roll contact position as an initial curvature radius; setting a curvature radius remaining in the workpiece when the workpiece is fed out from the bending roll contact position to achieve the design curvature radius in the roll-formed component as a final curvature radius; setting the initial curvature radius as a curvature radius to be applied to the workpiece before spring back occurs by applying bending to the workpiece; setting the unit portion positioned at the fulcrum roll contact position at the time when the workpiece is fed to a nip between the fulcrum roll and the bending roll as a fulcrum roll unit portion; setting the unit portion positioned at the bending roll contact position as a bending roll unit portion; setting the unit portion positioned between the unit portions above, corresponding to each of the unit intervals, as an intermediate unit portion; applying an intermediate curvature radius set so as to continuously change curvature of the intermediate unit portion from the initial curvature radius to the design curvature radius to the intermediate unit portion, to apply the initial curvature radius corresponding to the unit portion to the fulcrum roll unit portion and apply the design curvature radius corresponding to the unit portion to the bending roll unit portion; applying the design curvature radius to the bending roll unit portion; integrating an amount of change in bending position in each of the intermediate unit portion and the bending roll unit portion; and moving the roll moving unit, and at least one of the fulcrum roll and the bending roll using the roll moving unit on the basis of this integrated value.

The present invention can be widely and suitably used in the field of manufacturing a roll-formed component including a portion in which a curvature radius continuously changes by subjecting a workpiece to roll bending along its longitudinal direction.

From the above description, many modifications and other embodiments of the present invention are apparent to a person skilled in the art. Thus, the above description is to be construed only as illustrative examples, and is provided for a purpose of teaching the best mode of practicing the invention to a person skilled in the art. Details of structure and/or function of the present invention can be substantially changed without departing from the spirit of the present invention.

What is claimed is:

1. An apparatus configured to manufacture a roll-formed component with curvature changing along a longitudinal direction of the roll-formed component by applying roll bending to a workpiece including an elongated sheet or an elongated extrusion material along a longitudinal direction of the workpiece, the apparatus comprising:

a fulcrum roll that is positioned on an upstream side of a bending path and is configured to support the workpiece during bending, or to serve as a fulcrum of bending;

a bending roll that is positioned on a downstream side of the bending path and is configured to apply bending to the workpiece;

an actuator that is configured to move at least one of the fulcrum roll and the bending roll; and a controller, wherein under the following conditions:

a position allowing the fulcrum roll to be brought into contact with the workpiece is set as a fulcrum roll contact position;

a position allowing the bending roll to be brought into contact with the workpiece is set as a bending roll contact position;

the roll-formed component is composed of a plurality of unit intervals along the longitudinal direction, a portion of the workpiece corresponding to each of the unit intervals in the roll-formed component is set as a unit portion;

a value of a curvature radius to be applied to the workpiece at the fulcrum roll contact position is set as an initial curvature radius;

a value of a curvature radius allowed to remain in the workpiece when the workpiece is fed out from the bending roll contact position is set as a final curvature radius, the unit portion positioned at the fulcrum roll contact position at a time when the workpiece is fed between the fulcrum roll and the bending roll is set as a fulcrum roll unit portion;

the unit portion positioned at the bending roll contact position is set as a bending roll unit portion; and the unit portion positioned between the fulcrum roll unit portion and the bending roll unit portion is set as an intermediate unit portion, the controller is configured to:

integrate an amount of change in a bending position in each of the intermediate unit portion and the bending roll unit portion based on the initial curvature radius and the final curvature radius at an arbitrary time point when the workpiece is fed between the fulcrum roll and the bending roll, and cause the actuator to be driven to move at least one of the fulcrum roll or the bending roll based on the integrated amount of change.

2. The apparatus according to claim 1, wherein, when an intermediate curvature radius is set so as to continuously change a curvature of the intermediate unit portion from the initial curvature radius to the final curvature radius, the controller is configured to:

integrate the amount of change in bending position in each of the intermediate unit portion and the bending roll unit portion based on the intermediate curvature radius and the final curvature radius which are set at an arbitrary time point when the workpiece is fed between the fulcrum roll and the bending roll.

3. The apparatus according to claim 2, wherein the controller is configured to integrate the amount of change in the bending position under the following conditions: the intermediate curvature radius is set from a value of the initial curvature radius applied to a given unit portion at the fulcrum roll contact position, and a change in strain or deflection due to a variation in bending moment when the given unit portion moves toward the bending roll contact position.

4. The apparatus according to claim 3, wherein the controller is configured to integrate the amount of change in the bending position under a condition that the intermediate curvature radius is set by considering that strain or bending moment at the intermediate unit portion decreases gradually as the intermediate unit portion is moved in a direction from the fulcrum roll to the bending roll.

5. The apparatus according to claim 1, wherein the controller is configured to integrate the amount of change in the bending position under the following conditions:

a design value of a curvature radius of each unit portion of the roll-formed component to be formed is set as a design curvature radius, and the final curvature radius is set based on the design curvature radius.

6. The apparatus according to claim 5, further comprising a curvature radius database that is configured to store at least the design curvature radius and the initial curvature radius in all the unit portions of the roll-formed component, wherein the controller is configured to calculate the integrated amount of change with reference to the curvature radius database.

7. The apparatus according to claim 6, wherein:

the curvature radius database is configured to store a plurality of values as the initial curvature radius based on at least physical properties of the workpiece, and the controller is configured to control the actuator according to the plurality of values of the initial curvature radius.

8. The apparatus according to claim 1, wherein the controller is configured to integrate the amount of change in the bending position under a condition that a curvature radius applied to the workpiece before occurrence of spring back or reduction of strain is set as the initial curvature radius in association with the final curvature radius.

9. The apparatus according to claim 1, further comprising a feeding roll positioned upstream of the fulcrum roll in the bending path and configured to feed the workpiece toward the fulcrum roll.

10. The apparatus according to claim 1, wherein the fulcrum roll is configured to be fixed in position and only the bending roll is configured to be moved by the actuator.

11. The apparatus according to claim 1, wherein the workpiece just before being subjected to bend by the bending roll has a cross-section including a folded portion or a bent portion in its cross-sectional direction.

12. The apparatus according to claim 1, wherein the roll-formed component includes a portion where at least one of width or thickness changes continuously or stepwise along its longitudinal direction.

13. The apparatus according to claim 12, further comprising a roll unit including a pair of rolls for continuously or stepwise changing at least one of width or thickness of the workpiece in the longitudinal direction.

14. The apparatus according to claim 1, wherein at least one of the fulcrum roll or the bending roll includes a pair of rolls.

15. The apparatus according to claim 1, wherein the roll-formed component is a frame component for an aircraft.

16. An apparatus configured to manufacture a roll-formed component with curvature changing along a longitudinal direction of the roll-formed component by applying roll bending to a workpiece including an elongated sheet or an elongated extrusion material along a longitudinal direction of the workpiece, the apparatus comprising:

a fulcrum roll that is positioned on an upstream side in a bending path and is configured to support the workpiece during bending, or to serve as a fulcrum of bending;

a bending roll that is positioned on a downstream side in the bending path and is configured to apply bending to the workpiece;

an actuator that is configured to move at least one of the fulcrum roll and the bending roll;

at least one of a curvature radius database or an NC program; and a controller, wherein under the following conditions:

a position allowing the fulcrum roll to be brought into contact with the workpiece is set as a fulcrum roll contact position;

a position allowing the bending roll to be brought into contact with the workpiece is set as a bending roll contact position;

the roll-formed component is composed of a plurality of unit intervals along the longitudinal direction, a portion of the workpiece corresponding to each of the unit intervals in the roll-formed component is set as a unit portion;

a value of a curvature radius applied to the workpiece at the fulcrum roll contact position is set as an initial curvature radius;

a value of a curvature radius allowed to remain in the workpiece when the workpiece is fed out from the bending roll contact position to achieve a design curvature radius in the roll-formed component is set as a final curvature radius, the unit portion positioned at the fulcrum roll contact position at a time when the workpiece is fed between the fulcrum roll and the bending roll is set as a fulcrum roll unit portion;

the unit portion positioned at the bending roll contact position is set as a bending roll unit portion; and the unit portion positioned between the fulcrum roll unit portion and the bending roll unit portion is set as an intermediate unit portion, the curvature radius database is configured to store an integrated value of an amount of change in a bending position in each of the intermediate unit portion and the bending roll unit portion, the integrated value being calculated for each unit portion of the roll-formed component based on the initial curvature radius and the final curvature radius, the NC program is configured based on the integrated value of an amount of change in a bending position in each of the intermediate unit portion and the bending roll unit portion, the integrated value being calculated for each unit portion of the roll-formed component to be formed based on the initial curvature radius and the final curvature radius, and the controller is configured to cause the actuator to be driven to move at least one of the fulcrum roll and the bending roll with reference to at least one of the integrated value stored in the curvature radius database or the NC program.

17. The apparatus according to claim 16, wherein when an intermediate curvature radius for the intermediate unit portion is set so as to continuously change curvature of the intermediate unit portion from the initial curvature radius to the final curvature radius, the curvature radius database is configured to store the integrated value of an amount of change in bending position in each of the intermediate unit portion and the bending roll unit portion, the integrated value being calculated for each unit portion of the roll-formed component based on the intermediate curvature radius and the final curvature radius, and the NC program is configured based on the integrated value of an amount of change in a bending position in each of the intermediate unit portion and the bending roll unit portion, the integrated value being calculated for each unit portion of the roll-formed component to be formed based on the intermediate curvature radius and the final curvature radius.

18. A method of manufacturing a roll-formed component including a portion with curvature changing along a longitudinal direction thereof by applying roll bending to a workpiece including an elongated sheet or an elongated extrusion material along a longitudinal direction of the workpiece using a fulcrum roll positioned on an upstream side in a roll bending path and a bending roll positioned on a downstream side in the roll bending path, the method comprising:

applying an initial curvature radius to the workpiece at a position where the fulcrum roll is in contact with the workpiece;

applying a final curvature radius to the workpiece at a position where the bending roll is in contact with the workpiece;

dividing a region of the workpiece into a plurality of unit intervals, the region being between the position where the fulcrum roll is in contact with the workpiece and the position where the bending roll is in contact with the workpiece, wherein a downstream end of each unit interval is set as a unit portion;

integrating an amount of change in bending position in each unit portion based on the initial curvature radius and the final curvature radius at an arbitrary time point when the workpiece is fed between the fulcrum roll and the bending roll; and moving at least one of the fulcrum roll or the bending roll based on the integrated amount of change.

* * * * *